US010854414B2

(12) United States Patent
Shea

(10) Patent No.: US 10,854,414 B2
(45) Date of Patent: Dec. 1, 2020

(54) HIGH VOLTAGE ELECTRICAL DISCONNECT DEVICE WITH MAGNETIC ARC DEFLECTION ASSEMBLY

(71) Applicant: EATON INTELLIGENT POWER LIMITED, Dublin (IE)

(72) Inventor: John Joseph Shea, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 86 days.

(21) Appl. No.: 15/151,949

(22) Filed: May 11, 2016

(65) Prior Publication Data

US 2017/0330720 A1 Nov. 16, 2017
US 2018/0151323 A9 May 31, 2018

(51) Int. Cl.

| | |
|---|---|
| ***H01H 85/38*** | (2006.01) |
| ***H01H 33/10*** | (2006.01) |
| ***H01H 33/18*** | (2006.01) |
| ***H01H 85/20*** | (2006.01) |
| ***H01H 9/10*** | (2006.01) |
| ***H01H 9/34*** | (2006.01) |
| ***H01H 9/44*** | (2006.01) |
| *H01H 9/36* | (2006.01) |

(Continued)

(52) U.S. Cl.

CPC ..... *H01H 85/38* (2013.01); *H01H 9/10* (2013.01); *H01H 9/346* (2013.01); *H01H 9/443* (2013.01); *H01H 33/10* (2013.01); *H01H 33/182* (2013.01); *H01H 85/205* (2013.01); *H01H 21/16* (2013.01); *H01H 85/0241* (2013.01); *H01H 2009/365* (2013.01); *H01H 2085/386* (2013.01)

(58) Field of Classification Search

CPC ..... H01H 2009/348; H01H 2033/888; H01H 33/7015; H01H 33/7092; H01H 85/42; H01H 85/43

USPC ..... 337/142, 143, 273, 282

See application file for complete search history.

(56) References Cited

U.S. PATENT DOCUMENTS

| | | | |
|---|---|---|---|
| 685,766 | A | 11/1901 | Jones |
| 2,677,032 | A | 4/1954 | Wells |

(Continued)

FOREIGN PATENT DOCUMENTS

| | | |
|---|---|---|
| AU | 6805098 A | 12/1998 |
| CA | 905466 | 7/1972 |

(Continued)

OTHER PUBLICATIONS

International Search Report and Written Opinion for International Application No. PCT/US2014/029521, dated Jul. 14, 2017, 16 pages.

(Continued)

*Primary Examiner* — Stephen S Sul

(74) *Attorney, Agent, or Firm* — Armstrong Teasdale LLP

(57) ABSTRACT

A compact disconnect device includes a magnetic arc deflection assembly including at least one set of stacked arc plates and at least one magnet disposed adjacent switchable contacts and establishing a magnetic field across the stacked arc plates. The magnetic arc deflection assembly facilitates reliable connection and disconnection of DC voltage circuitry well above 125 VDC with reduced arcing intensity and duration. The disconnect device may be a compact fusible disconnect switch device having dual sets of switch contacts in the same current path.

12 Claims, 17 Drawing Sheets

(51) Int. Cl.
*H01H 85/02* (2006.01)
*H01H 21/16* (2006.01)

(56) References Cited

U.S. PATENT DOCUMENTS

| | | | | |
|---|---|---|---|---|
| 3,684,849 | A | 8/1972 | Zubaty | |
| 4,451,718 | A | 5/1984 | Yamagata | |
| 4,514,716 | A | 4/1985 | Vincent De Araujo | |
| 4,661,807 | A | 4/1987 | Panaro | |
| 4,752,660 | A | 6/1988 | Yokoyama et al. | |
| 4,794,362 | A | 12/1988 | Oakes et al. | |
| 4,962,406 | A | 10/1990 | Walker et al. | |
| 5,291,167 | A | 3/1994 | Richter | |
| 5,588,876 | A | 12/1996 | Hayes et al. | |
| 5,592,079 | A | 1/1997 | Scheel | |
| 5,633,483 | A | 5/1997 | Oster et al. | |
| 5,770,994 | A | 6/1998 | Evans | |
| 5,793,275 | A | 8/1998 | Iversen | |
| 5,920,131 | A | 7/1999 | Platt et al. | |
| 6,008,459 | A | 12/1999 | Faber et al. | |
| 6,188,332 | B1 | 2/2001 | Scarlata | |
| 6,194,984 | B1 * | 2/2001 | Kappel | H01H 50/546 218/152 |
| 6,498,326 | B1 | 12/2002 | Knappe | |
| 6,700,466 | B1 | 3/2004 | Yamamoto et al. | |
| 6,809,282 | B2 | 10/2004 | Fasano | |
| 6,812,435 | B2 | 11/2004 | Schilling | |
| 6,838,785 | B2 | 1/2005 | Schilling | |
| 7,474,194 | B2 | 1/2009 | Darr et al. | |
| 7,495,540 | B2 | 2/2009 | Darr et al. | |
| 7,924,136 | B2 | 4/2011 | Darr et al. | |
| 8,106,733 | B2 | 1/2012 | Nakasuji et al. | |
| 8,334,740 | B2 | 12/2012 | Annis et al. | |
| 8,519,292 | B2 | 8/2013 | Domejean | |
| 8,661,719 | B2 | 3/2014 | Hughes et al. | |
| 8,835,814 | B2 | 9/2014 | Apetauer et al. | |
| 2006/0055498 | A1 | 3/2006 | Darr et al. | |
| 2006/0125596 | A1 | 6/2006 | Darr et al. | |
| 2007/0188290 | A1 | 8/2007 | Nakasuji et al. | |
| 2008/0296264 | A1 | 12/2008 | Schulz et al. | |
| 2009/0128280 | A1 | 5/2009 | Darr et al. | |
| 2009/0321233 | A1 * | 12/2009 | Ferree | H01H 1/2041 200/244 |
| 2011/0169599 | A1 | 7/2011 | Darr et al. | |
| 2011/0193675 | A1 | 8/2011 | Darr et al. | |
| 2011/0221563 | A1 | 9/2011 | Su | |
| 2012/0268233 | A1 | 10/2012 | Weber et al. | |
| 2013/0015940 | A1 | 1/2013 | Dunker | |
| 2013/0057369 | A1 | 3/2013 | Yano et al. | |
| 2013/0075367 | A1 * | 3/2013 | Eriksson | H01H 9/40 218/34 |
| 2013/0106543 | A1 | 5/2013 | Isozaki et al. | |
| 2013/0112655 | A1 | 5/2013 | Theisen et al. | |
| 2013/0228551 | A1 | 9/2013 | Asokan et al. | |
| 2013/0264311 | A1 | 10/2013 | Lang et al. | |
| 2014/0014622 | A1 | 1/2014 | Naka et al. | |
| 2014/0043133 | A1 * | 2/2014 | Douglass | H01H 9/10 337/4 |
| 2014/0061160 | A1 * | 3/2014 | Juds | H01H 9/443 218/26 |
| 2015/0027984 | A1 | 1/2015 | Mattlar et al. | |
| 2015/0054605 | A1 | 2/2015 | Kubono et al. | |
| 2015/0114934 | A1 * | 4/2015 | Juds | H01H 33/08 218/149 |

FOREIGN PATENT DOCUMENTS

| | | | |
|---|---|---|---|
| CA | 2820116 | A1 | 6/2012 |
| CN | 201117605 | Y | 9/2008 |
| CN | 101315852 | A | 12/2008 |
| CN | 201430111 | Y | 3/2010 |
| CN | 102592910 | A | 7/2012 |
| CN | 202736866 | U | 2/2013 |
| DE | 2434897 | A1 | 2/1976 |
| DE | 102012214881 | A1 | 2/2014 |
| DE | 102012223168 | A1 | 3/2014 |
| EP | 2605265 | A1 | 6/2013 |
| EP | 2690639 | A1 | 1/2014 |
| ES | 2437580 | T3 | 1/2014 |
| GB | 619239 | | 3/1949 |
| IN | 697/MUM/2011 | | 7/2013 |
| JP | H11329206 | A | 11/1999 |
| JP | H11339605 | A | 12/1999 |
| JP | 2002260475 | A | 9/2002 |
| JP | 2007324038 | A | 12/2007 |
| JP | 2008300094 | A | 12/2008 |
| JP | 2011150983 | A | 8/2011 |
| JP | 2012146472 | A | 8/2012 |
| JP | 5303022 | B2 | 10/2013 |
| JP | 2013235748 | A | 11/2013 |
| JP | 5368150 | B2 | 12/2013 |
| JP | 2013242977 | A | 12/2013 |
| JP | 2014056731 | A | 3/2014 |
| KR | 101031975 | B1 | 5/2011 |
| KR | 101214007 | B1 | 12/2012 |
| WO | 2011127654 | A1 | 10/2011 |
| WO | 2014039162 | A1 | 3/2014 |

OTHER PUBLICATIONS

International Search Report and Written Opinion for International Application PCT/US20161020199, dated May 24, 2016, 11 pages.
International Search Report and Written Opinion for International Application PCT/US2016/022627, dated Mar. 16, 2016, 16 pages.

* cited by examiner

HIGH VOLTAGE ELECTRICAL DISCONNECT DEVICE WITH MAGNETIC ARC DEFLECTION ASSEMBLY

BACKGROUND OF THE INVENTION

The field of the invention relates generally to electrical disconnect devices and assemblies, and more specifically to disconnect devices configured for higher voltage direct current (DC) industrial applications.

Various assemblies are known that provide disconnect functionality between a power supply circuit and an electrical load. For example, circuit breaker devices, switch devices and contactor devices typically include an input terminal connectable to power supply or line-side circuitry, an output terminal connectable to one or more electrical loads, and at least one pair of switch contacts between the input terminal and output terminal. The pair of switch contacts typically includes a stationary contact and a movable contact linked to an actuator element that displaces the movable contact along a predetermined path of motion toward and away from the stationary contact to connect and disconnect the circuit path through the device and electrically connecting or isolating the electrical load through the device. The actuator element may be manually movable and/or automatically movable for circuit protection purposes to open the switch contacts in response to fault conditions in the line-side circuit and electrically isolate the electrical load(s) from fault conditions to prevent damage. Circuit breakers and fusible disconnect switch devices are two well-known types of devices that each have a different type of disconnect functionality.

Direct current (DC) power systems present particular challenges for the type of disconnect devices discussed above, particularly for higher voltage DC power systems. For example, a variety of fusible disconnect switch devices are known in the art wherein fused output power may be selectively switched from a power supply input, but existing fusible disconnect switch devices have yet to completely met the needs of the marketplace and improvements are desired.

Higher voltage, direct current applications present additional demands on fusible disconnect switch devices that are not well met by existing fusible disconnect devices. Specifically, in DC power systems operating at about 125 VDC and above, the arc energy associated with electrical arcing as the switch contacts are opened or closed increases considerably. Conventional disconnect devices for lower power DC circuitry are not equipped to satisfactorily manage and contain the increased arc energy potential presented by desired higher voltage DC circuitry. Improvements are therefore desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Exemplary embodiments of the present invention are described below in the exemplary context of a fusible disconnect switch device, although as noted below the invention may likewise be applied other types of disconnect devices such as circuit breakers, non-fusible disconnect switches and contactors. The exemplary embodiments described below are therefore offered for the sake of illustration rather than limitation, as the benefits of the invention may accrue more generally to devices other than those specifically illustrated and described herein.

Advantageously, exemplary embodiments of fusible disconnect devices are described hereinbelow that may capably contain and dissipate electrical arcing as switch contacts are opened and closed in DC power systems operable at system voltages well exceeding 125 VDC that has until now been a practical upper bound for certain types of conventional disconnect devices. This is achieved at least in part with magnetic arc defection features and arc mitigation elements that provide for much higher direct current ratings of the devices, as well as switching arrangements that are not polarity dependent for additional flexibility and ease of use when installing disconnect devices. Method aspects will in part be apparent and in part will be specifically discussed in the description below.

Figure 1:
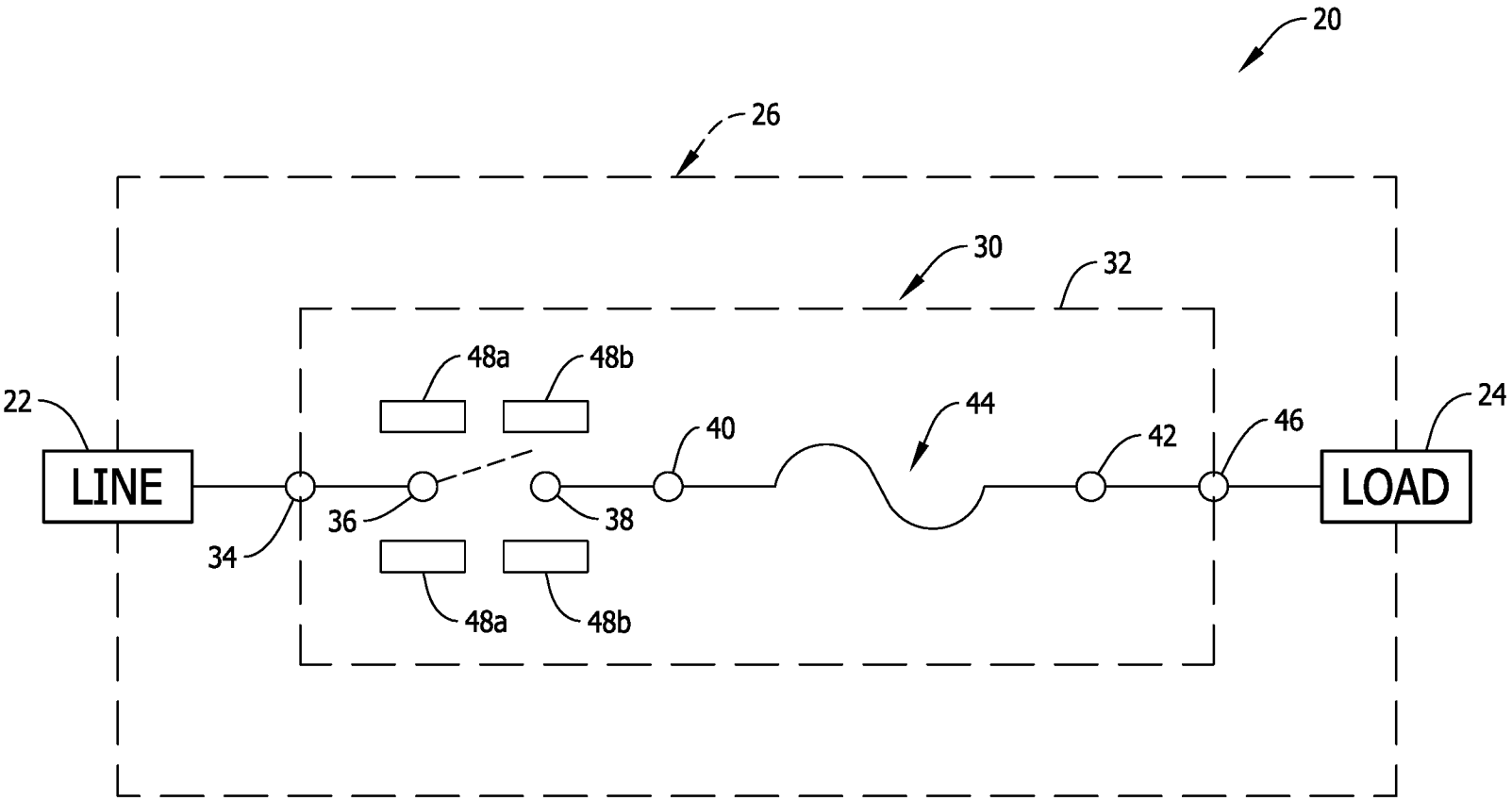
FIG. 1 is a circuit schematic of an exemplary electrical power distribution system including a disconnect device formed in accordance with an exemplary embodiment of the present invention.

FIG. 1 schematically illustrates an electrical power system 20 for supplying electrical power from a power supply or line-side circuitry 22 to power receiving or load-side circuitry 24. In contemplated embodiments the line-side circuitry 22 and load-side circuitry 24 may be associated with a panelboard 26 that includes a fusible switching disconnect device 30. While one fusible switching disconnect device 30 is shown, it is contemplated that in a typical installation a plurality of fusible switching disconnect devices 30 would be provided in the panel board 26 that each respectively receives input power from the line-side circuitry 22 via, for example, a bus bar (not shown), and outputs electrical power to one or more of various different electrical loads 24 associated with branch circuits of the larger electrical power system 20.

The fusible switching disconnect device 30 may be configured as a compact fusible switching disconnect device such as those described further below that advantageously combine switching capability and enhanced fusible circuit protection in a single, compact switch housing 32. As shown in FIG. 1, the fusible switching disconnect device 30 defines a circuit path through the switch housing 32 between the line-side circuitry 22 and the load-side circuitry 24. The circuit path of the example fusible switching disconnect device 30 includes, as shown in FIG. 1, a line-side input connecting terminal 34, switchable contacts 36 and 38, fuse contact terminals 40 and 42, a removable overcurrent protection fuse 44 connected between the fuse contact terminals 40 and 42, and a load-side output connecting terminal 46. Each of the elements 34, 36, 38, 40, 42 and 46 that define the circuit path are included in the housing 32 while the overcurrent protection fuse 44 is separately provided but used in combination with the housing 32 and the conductive elements 34, 36, 38, 40, 42 and 46 in the switch housing 32.

In an alternative embodiment, the overcurrent protection fuse 44 and the fuse contact terminals 40 and 42 may be omitted to provide a more basic, non-fusible disconnect device that is otherwise similar to the device 30 depicted in FIG. 1. Either way, the switch contacts 36, 38 are movable between opened and closed positions to electrically connect or isolate the line-side connecting terminal 34 and the fuse contact terminal 40 and hence connect or disconnect the load-side circuitry 24 from the line-side circuitry 22 when desired.

When the fusible switching disconnect device 30 is connected to energized line-side circuitry 22, and also when the switch contacts 36, 38 are closed as shown in FIG. 1 and the fuse 44 is intact, electrical current flows through the line-side connecting terminal 34 of the fusible switching disconnect device 30 and through the switchable contacts 36 and 38, to and through the fuse contact terminal 40 and the fuse 44 to the fuse contact terminal 42, and to and through the load-side connecting terminal 46 to the load. When the switch contacts 36, 38 are opened, an open circuit is established between them in the switch housing 32 of the fusible switching disconnect device 30 and the load-side circuitry 24 is electrically isolated or disconnected from the line-side circuitry 22 via the fusible switching disconnect device 30. When the switch contacts 36, 38 are again closed, electrical current flow resumes through the current path in the fusible switching disconnect device 30 and the load-side circuitry 24 is again connected to the line-side circuitry 22 through the fusible switching disconnect device 30.

When the overcurrent protection fuse 44 is subjected to a predetermined electrical current condition when the switch contacts 38, 38 are closed, however, the overcurrent protection fuse 44, and specifically the fusible element (or fusible elements) therein is configured to permanently open or fail to conduct current any longer, creating an open circuit between the fuse contact terminals 40 and 42. When the overcurrent protection fuse 44 opens in such a manner, current flow through the fusible switching disconnect device 30 is interrupted and possible damage to the load-side circuitry 124 is avoided. In one contemplated embodiment, the fuse 44 may be a rectangular fuse module such as a CUBEFuse™ power fuse module commercially available from Bussmann by Eaton of St. Louis, Mo. In other embodiments, the overcurrent protection fuse 44 may be a cylindrical fuse such as a Class CC fuse, a so-called Midget fuse, or an IEC 10×38 fuse also available from Bussmann by Eaton.

Because the overcurrent protection fuse 44 permanently opens, the overcurrent protection fuse 44 must be replaced to once again complete the current path between the fuse contact terminals 40 and 42 in the fusible switching disconnect device 30 such that power can again be supplied to the load-side circuitry 24 via the fusible switching disconnect device 30. In this aspect, the fusible switching disconnect device 30 is contrasted with a circuit breaker device that is known to provide overcurrent protection via a resettable breaker element. At least in part because the device 30 depicted does not involve or include a resettable circuit breaker element in the circuit path completed in the switch housing 32, the fusible switching disconnect device 30 is considerably smaller than an equivalently rated circuit breaker device providing similar overcurrent protection performance. In another embodiment, however, a circuit breaker element may be included in lieu of the overcurrent protection fuse 44, with the switch contacts integrated into the circuit breaker element in a known manner. If the circuit breaker is manually operable as in some types of molded case circuit breakers, the circuit breaker has a built-in disconnect functionality. In still another alternative embodiment, a circuit breaker element may be provided in combination with the overcurrent protection fuse 44 as desired.

As compared to conventional arrangements wherein fusible devices are connected in series with separately packaged switching elements, the fusible switching disconnect device 30 is relatively compact and can provide substantial reduction in size and cost while providing comparable, if not superior, circuit protection performance.

When a number compact fusible switching disconnect devices 30 are utilized in combination in a panelboard 26, current interruption ratings of the panelboard 26 may be increased while the size of the panelboard 26 may be simultaneously reduced. The compact fusible disconnect device 30 may also advantageously accommodate fuses 44 without involving a separately provided fuse holder or fuse carrier that is found in certain types of conventional fusible disconnect switch devices. The compact fusible disconnect device 30 may also be configured to establish electrical connection to the fuse contact terminals 40, 42 without fastening of the fuse 44 to the line and load-side terminals with separate fasteners, and therefore provide still further benefits by eliminating certain components of conventional fusible disconnect constructions while simultaneously providing a lower cost, yet easier to use fusible circuit protection product 30.

Presently available compact fusible disconnect devices such as Compact Circuit Protection (CCP) devices available from Bussmann by Eaton of St. Louis, Mo. provide the functionality and benefits described thus far in relation to the switch housing 32 and the associated terminals and contacts, but are nonetheless limited in some aspects for particular applications involving higher voltage direct current (DC) power systems.

Unlike AC power systems where electrical arcing has an opportunity to extinguish at any voltage zero crossing of the alternating voltage wave, the DC current and voltage potential remain at a constant level during the breaking of switch contacts making it very difficult for the arc to extinguish. This constant DC voltage potential further tends to create sustained arcing conditions that will erode the switch contacts very quickly. Sustained high temperatures associated with DC arcing conditions can contribute to further switch mechanism degradation, and perhaps may even lead to catastrophic failure of the fusible switching disconnect device if not carefully controlled. Of course, as the voltage of the DC circuitry increases, electrical arcing issues become more severe.

Presently available compact fusible disconnect devices of otherwise similar type can safely break a DC circuit having a voltage potential of about 125 VDC or less. For DC power systems operating above 125 VDC, the arc energy associated with electrical arcing as the switch contacts 36, 38 are opened or closed increases considerably and exceeds the ability of presently available compact fusible disconnect devices to reliably withstand. Compact fusible disconnect devices are now desired that may operate not only at 125 VDC and above, but also at much higher DC voltages such as 400 VDC, 600 VDC and even 1000 VDC. Improvements are therefore desired.

To address arcing concerns of 125 VDC operation and above, the compact fusible disconnect device 30 of the invention includes at least one magnet, and in the example shown in FIG. 1 a set of magnets 48, arranged to provide an arc deflecting force to more quickly extinguish the arc and its intensity as switching occurs in the switch housing 32. In contemplated embodiments, the set of magnets 48 may include a first pair of magnets 48*a* and a second pair of magnets 48*b* arranged to provide an arc deflecting force proximate each of the switch contacts 36 and 38. Also in contemplated embodiments, the first pair of magnets 48*a* and the second pair of magnets 48*b* may be arranged to provide oppositely directed arc deflection forces proximate each switch contact 36 and 38. By providing two switch contacts 36, 38, the electrical arc is divided over the two locations corresponding to each contact 36 and 38, and via the pairs of magnets 48*a*, 48*b* providing the arc deflecting force on each respective contact 36 and 38, electrical arcing is less severe and shorter in duration than it otherwise would be, allowing the compact fusible disconnect device 30 to safely and capably operate to disconnect the line-side circuitry 22 and electrically isolate the load-side circuitry 24 at much higher operating DC voltages beyond the capability of known fusible disconnect switch devices. Voltage potentials as high as 1000 VDC may be reliably and safely disconnected by virtue of the set of magnets 48. In other embodiments, DC voltage potential breaking may still be improved, but to a lesser extent, by providing one pair of magnets instead of two in certain switching arrangements, and even with a single magnet in other possible switching arrangements.

Figure 2:
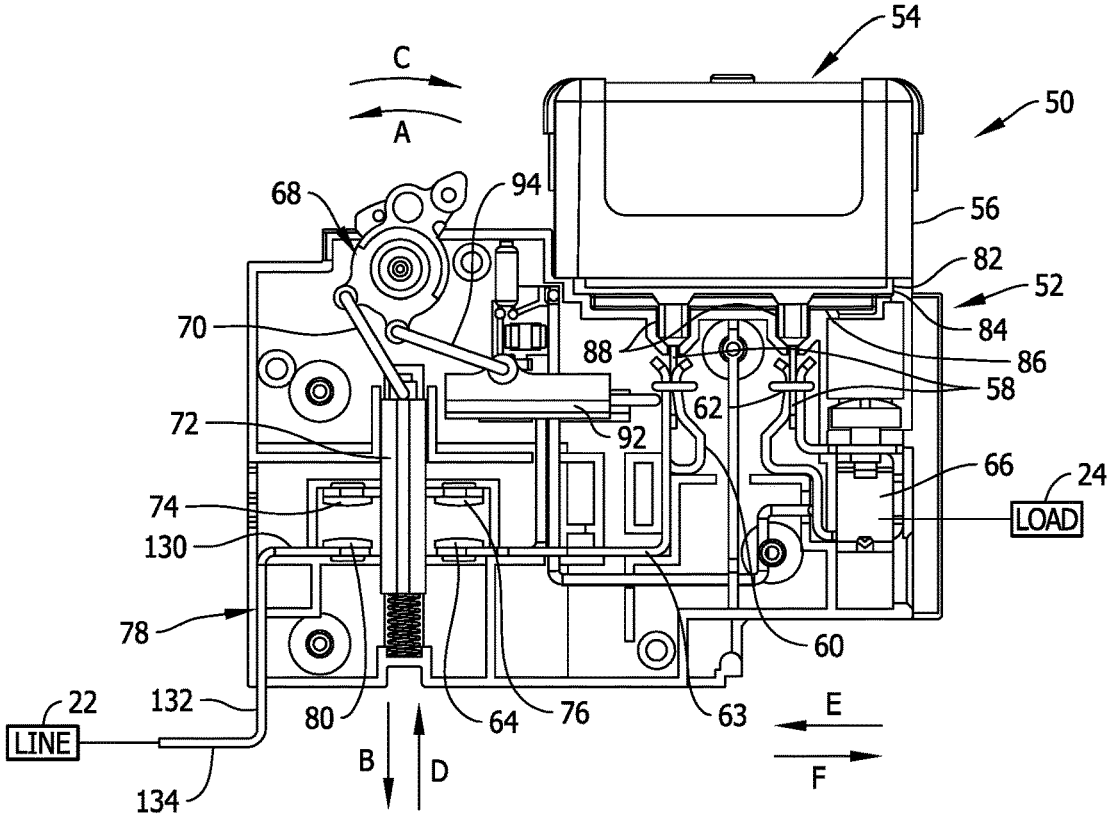
FIG. 2 is a partial longitudinal side elevational view of a first embodiment of a fusible disconnect switch device for the electrical power distribution system shown in FIG. 1.
Figure 3:
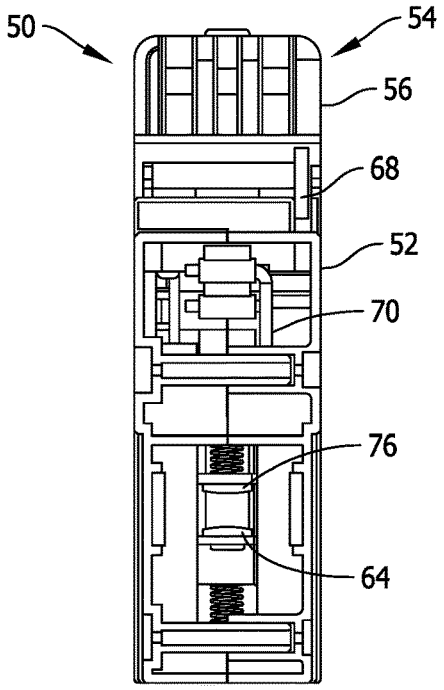
FIG. 3 is a partial lateral sectional view of the fusible disconnect switch device shown in FIG. 2.

FIGS. 2 and 3 illustrate a more specific example of a compact fusible disconnect switch device assembly 50 that provides the functionality described above in relation to the compact fusible disconnect device 30. As shown in FIGS. 2 and 3, the fusible disconnect switch device assembly 50 includes a non-conductive switch housing 52 configured or adapted to receive a retractable rectangular fuse module 54. The fuse module 54 is a known assembly including a rectangular housing 56, and terminal blades 58 extending from the housing 56. A primary fuse element or fuse assembly is located within the housing 56 and is electrically connected between the terminal blades 58. Such fuse modules 54 are known and in one embodiment the rectangular fuse module is a CUBEFuse™ power fuse module commercially available from Bussmann by Eaton of St. Louis, Mo.

A line-side input fuse clip 60 may be situated within the switch housing 52 and may receive one of the terminal blades 58 of the fuse module 54. A load-side fuse clip 62 may also be situated within the switch housing 52 and may receive the other of the fuse terminal blades 58. The line-side fuse clip 60 may be electrically connected to a line-side terminal 63 including a stationary switch contact 64. The load-side fuse output clip 62 may be electrically connected to a load-side terminal 66.

A rotary switch actuator 68 is further provided on the switch housing 52, and is mechanically coupled to an actuator link 70 that, in turn is coupled to a sliding actuator bar 72. The actuator bar 72 carries a pair of switch contacts 74 and 76. A load-side terminal 78 including a stationary contact 80 is also provided. Electrical connection to power supply or line-side circuitry 22 may be accomplished in a known manner using the line-side terminal 78, and an electrical connection to load-side circuitry 24 may be accomplished in a known manner using the load-side terminal 66. A variety of connecting techniques are known (e.g., box lug terminals, screw clamp terminals, spring terminals, and the like) and may be utilized. The configuration of the line and load-side terminals 78 and 66 shown are exemplary only, and in the example of FIG. 2 the line and load-side terminals 78 and 66 are differently configured. In the embodiment illustrated, the line-side terminal 78 is configured as a panel mount clip (also shown in FIG. 7) while the load-side terminal 66 is configured as a box lug terminal. In alternative embodiments, however, the load-side terminal 66 and line-side terminal 78 instead of being different types of terminals may be configured to be the same (e.g., both may be configured as box lug terminals or as another terminal configuration as desired).

Disconnect switching may be accomplished by rotating the switch actuator 68 in the direction of arrow A, causing the actuator link 70 to move the sliding bar 72 linearly in the direction of arrow B and moving the switch contacts 74 and 76 toward the stationary contacts 64 and 80 along a linear path of motion. Eventually, the switch contacts 74 and 76 become mechanically and electrically engaged to the stationary contacts 64 and 80 and a circuit path may be closed through the fuse 54 between the line and load terminals 78 and 66 when the fuse terminal blades 58 are received in the line and load-side fuse clips 60 and 62. This position, wherein the movable switch contacts 74 and 76 are mechanically and electrically connected to the stationary switch contacts 64 and 80 is referred to herein as a closed or connected position wherein the fusible disconnect switch device 50 electrically connects the line-side circuitry 22 and the load-side circuitry 24 through the fuse 54.

When the actuator 68 is moved in the opposite direction indicated by arrow C in FIG. 3, the actuator link 70 causes the sliding bar 72 to move linearly in the direction of arrow D and pull the switch contacts 74 and 76 away from the stationary contacts 64 and 80 along a linear path of motion to open the circuit path through the fuse 54 as shown in FIG. 3. This position wherein the movable switch contacts 74 and 76 are mechanically and electrically separated from the stationary switch contacts 64 and 80 is referred to herein as an opened or disconnected position wherein the fusible disconnect switch device 50 electrically disconnects the line-side circuitry 22 and the load-side circuitry 24.

As such, by moving the actuator 68 to a desired position to effect the opened or closed position of the switch contacts, the fuse 54 and associated load-side circuitry 24 may be connected and disconnected from the line-side circuitry 22 while the line-side circuitry 22 remains "live" in full power operation.

Additionally, the fuse module 54 may be simply plugged into the fuse clips 60, 62 or extracted therefrom to install or remove the fuse module 54 from the switch housing 52. The fuse housing 56 projects from the switch housing 52 and is open and accessible so that a person can grasp the fuse housing 56 by hand and pull it in the direction of arrow B to disengage the fuse terminal blades 58 from the line and load-side fuse clips 60 and 62 such that the fuse module 54 is completely released from the switch housing 52. Likewise, a replacement fuse module 54 can be grasped by hand and moved toward the switch housing 52 to engage the fuse terminal blades 58 to the line and load-side fuse clips 60 and 62.

Such plug-in connection and removal of the fuse module 54 advantageously facilitates quick and convenient installation and removal of the fuse 54 without requiring separately supplied fuse carrier elements and without requiring tools or fasteners common to other known disconnect devices. Also, the fuse terminal blades 58 project from a lower side of the fuse housing 56 that faces the switch housing 52. Moreover, the fuse terminal blades 58 extend in a generally parallel manner projecting away from the lower side of the fuse module 54 such that the fuse housing 56 (as well as a person's hand when handling it) is physically isolated from the conductive fuse terminals 58 and the conductive line and load-side fuse clips 60 and 62. The fuse module 54 is therefore touch safe (i.e., may be safely handled by hand without risk of electrical shock) when installing and removing the fuse 54.

Additionally, the disconnect device 50 is rather compact and can easily occupy less space in a fusible panelboard assembly, for example, than conventional in-line fuse and circuit breaker combinations. In particular, CUBEFuse™ power fuse modules occupy a smaller area, sometimes referred to as a footprint, in the panel assembly than non-rectangular fuses having comparable ratings and interruption capabilities. Reductions in the size of panelboards are therefore possible, with increased interruption capabilities.

In ordinary use, the circuit is preferably connected and disconnected at the switch contacts 64, 74, 76 and 80 rather than at the fuse clips 60 and 62. Electrical arcing that may occur when connecting/disconnecting the circuit may be contained at a location away from the fuse clips 60 and 62 to provide additional safety for persons installing, removing, or replacing fuses. By opening the disconnect module 50 with the switch actuator 68 before installing or removing the fuse module 54, any risk posed by electrical arcing or energized metal at the fuse and housing interface is eliminated. The disconnect module 50 is accordingly believed to be safer to use than many known fused disconnect switches.

The disconnect switching device 50 includes still further features, however, that improve the safety of the device 50 in the event that a person removes the fuse module 54 without operating the actuator 68 to disconnect the circuit through the fuse module 54.

As shown in FIG. 2, the switch housing 52 in one example includes an open ended receptacle or cavity 82 on an upper edge thereof that accepts a portion of the fuse housing 56 when the fuse module 54 is installed with the fuse terminal blades 58 engaged to the fuse clips 60, 62. The receptacle 82 is shallow in the embodiment depicted, such that the only a small portion of the fuse housing 56 is received therein, which facilitates the finger safe handling of the fuse module 54 for installation and removal without requiring tools. It is understood, however, that in other embodiments the fuse housing 56 need not project as greatly from the switch housing receptacle when installed, and indeed could even be substantially entirely contained with the switch housing 52 if desired.

In the exemplary embodiment shown, the fuse housing 56 includes a recessed guide rim 84 having a slightly smaller outer perimeter than a remainder of the fuse housing 56, and the guide rim 84 is seated in the switch housing receptacle 82 when the fuse module 54 is installed. It is understood, however, that the guide rim 84 may be considered entirely optional in another embodiment and need not be provided.

The switch housing receptacle 82 further includes a bottom surface 86, sometimes referred to as a floor, that includes first and second openings 88 formed therein and through which the fuse terminal blades 58 may be extended to engage them with the line and load-side fuse clips 60 and 62. In the example shown, the assembly further includes an interlock element 92 that is in turn coupled to the switch actuator 68 via a positioning arm or link 94. As the switch actuator 68 is rotated in the direction of arrow C to open the switch contacts 74 and 76, the link 94 pulls the interlock element 92 along a linear axis in the direction of arrow E away from the line-side fuse clip 60. In this state, the slidable plug-in connection of the fuse 54 and specifically line-side terminal blade 58 to the line-side fuse clip 60 is permitted, as well as removal of the line-side terminal blade 58 from the line-side fuse clip 60.

When the switch actuator 68 is rotated in the direction of arrow A, however, to the closed or "on" position wherein the switch contacts 74 and 76 are engaged with the stationary contacts 64 and 80, the interlock element 92 is slidably moved toward the line-side fuse clip 60 along the linear axis in the direction of arrow F toward the line-side fuse clip 60. An end of the interlock element is passed through an opening in the line-side terminal blade 58 as this happens and the line-side terminal blade 58 becomes effectively locked in place and frustrates any attempt to remove the fuse 54.

The switch actuator 68 simultaneously drives the sliding bar 72 along a first linear axis (i.e., a vertical axis in FIG. 2 as drawn) in the direction of arrow B or D and the slidable interlock element 92 along a second linear axis (i.e., a horizontal axis in FIG. 2 as drawn) in the direction of arrows E or F. Specifically, as the sliding bar 72 is moved in the direction of arrow B, the interlock element 92 is driven in the direction of arrow F toward the line-side fuse clip 60. Likewise, when the sliding bar 72 is moved in the direction of arrow D, the interlock element 92 is driven in the direction of arrow E away from the line-side fuse clip 60. The mutually perpendicular axes for the sliding bar 72 and the interlock element 92 is beneficial in that that the actuator 68 is stable in either the opened "off" position or the closed "on" position and a compact size of the disconnect device 50 is maintained. It is understood, however, that such mutually perpendicular axes of motion are not necessarily required for the sliding bar 72 and the interlock element 92. Other axes of movement are possible and may be adopted in alternative embodiments. On this note too, linear sliding movement is not necessarily required for these elements to function, and other types of movement (e.g., rotary or pivoting movement) may be utilized for these elements if desired.

Figure 4:
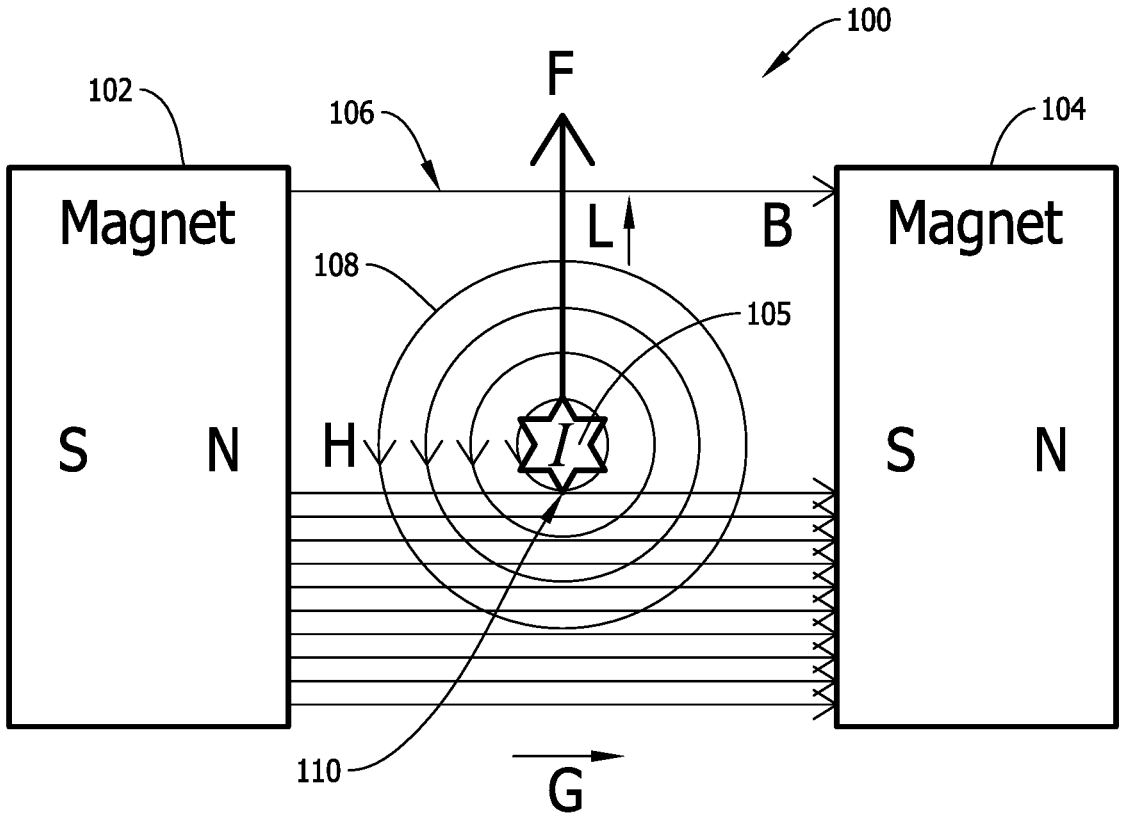
FIG. 4 is a schematic view of a portion of a magnet assembly for the fusible disconnect switch device shown in FIG. 2.

FIG. 4 is a schematic view of a portion of a magnet assembly 100 for the fusible disconnect switch device 50 to provide magnetic arc deflection that enhances performance capability in, for example, DC power systems operating above 125 VDC. The magnetic assembly 100 assists in quickly and effectively dissipating an increased amount of arc energy associated with electrical arcing as the switch contacts 74 and 76 are opened or closed that exceeds the ability of presently available compact fusible disconnect devices to reliably withstand. Using the principles of the magnetic assembly 100 described below, compact fusible disconnect devices 50 may be realized that may safely and reliably operate in electrical power systems operating at 125 VDC or above, and potentially much greater voltages for use in DC voltage power systems operating at 400 VDC, 600 VDC and even 1000 VDC. The interrupting capability of the fusible disconnect device 50 accordingly may greatly increase via the implementation of the magnetic assembly 100.

As seen in FIG. 4, the magnet assembly 100 includes a pair of magnets 102, 104 arranged on each side of a conductor 105 that may correspond to a terminal in the device 50 described above. In contemplated embodiments, each magnet 102, 104 is a permanent magnet that respectively imposes a magnetic field 106 having a first polarity between the pair of magnets 102, 104, and the conductor 105 is situated in the magnetic field 106. As shown in FIG. 4, the magnet 102 has opposing poles S and N and the magnet 104 also has opposing poles S and N. Between the pole N of magnet 102 and the pole S of magnet 104 the magnetic field B also indicated as 106 is established and generally oriented in the direction of arrow G. The magnetic field B has a strength that is dependent on the properties and spacing of the magnets 102 and 104. The magnetic field B may be established in a desired strength depending on the magnets utilized. The magnetic field B in contemplated embodiments is constant and is maintained regardless of whether the switch contacts 74, 76 are opened or closed.

When electrical current I flows through the conductor 105 in a direction normal to the plane of the page of FIG. 4 and more specifically in a direction flowing out of the plane of the page of FIG. 4, a separate magnetic field 108 is induced and as shown in FIG. 4 the magnetic field 108 extends circumferentially around the conductor 105 in the direction of arrows H. The strength or intensity of the magnetic field 108 is, however, dependent on the magnitude of the current flowing through the conductor. The greater the current magnitude, the greater the strength of the magnetic field 108 that is induced. Likewise, when no current flows through the conductor 105, no magnetic field 108 is established.

Above the conductor 105 in the example illustrated in FIG. 4, the magnetic field 108 and the magnetic field 106 generally oppose one another and at least partly cancel one another, while below the conductor as shown in FIG. 4, the magnetic field 108 and the magnetic field 106 combine to create a magnetic field of increased strength and density. The concentrated magnetic field beneath the conductor 105 produces a mechanical force F acting on the conductor 105. The force F extends in the example shown in the direction of arrow L that is, in turn, directed normal to the magnetic field B 106. The force F may be recognized as a Lorenz force having magnitude F determined by the following relationship:

$$F=IL\times B \tag{1}$$

It should now be evident that the magnitude of the force can be varied by applying different magnetic fields, different amounts of current, and different lengths (L) of conductor 105. The orientation of the force F is shown to extend in the vertical direction in the plane of the page of FIG. 4, but in general can be oriented in any direction desired according to Fleming's Left Hand Rule, a known mnemonic in the field.

Briefly, Fleming's Left Hand Rule illustrates that when current flows in a wire (e.g., the conductor 105) and when an external magnetic field (e.g., the magnetic field B illustrated by lines 106) is applied across that flow of current, the wire experiences a force (e.g., the force F) that is oriented perpendicularly both to the magnetic field and also to the direction of the current flow. As such, the left hand can be held so as to represent three mutually orthogonal axes on the thumb, first finger and middle finger. Each finger represents one of the current I, the magnetic field B and the force F generated in response. As one illustrative example, and considering the example shown in FIG. 4, the first finger may represent the direction of the magnetic field B (e.g., to the right in FIG. 4), the middle finger may represent may represent the direction of flow of the current I (e.g., out of the page in FIG. 4), and the thumb represents the force F. Therefore, the first finger is pointed to the right and the middle finger is oriented out of the page in FIG. 4, and the position of the thumb reveals that the force F that results is oriented in the direction of arrow L (e.g., toward the top of the page in FIG. 4).

By orienting the current flow I in different directions through the magnetic field B, and also by orienting the magnetic field B in different directions, forces F extending in directions other than the arrow L can be generated. Within the switch housing 52 of the device 50 (FIGS. 2 and 3), magnetic forces F can accordingly be directed in particular directions. For example, and according to Fleming's Left Hand Rule, if the current flow I was directed into the paper instead of out of the paper as previously described in relation to the FIG. 4 while keeping the magnetic field B oriented as shown in FIG. 4 (i.e., toward the right in FIG. 4), the force F generated would be oriented in a direction opposite to the arrow L (i.e., toward the bottom of the page in FIG. 4). Likewise, if the magnetic field B was oriented vertically instead of horizontally as illustrated in FIG. 4, forces F could be generated in horizontal directions according to Fleming's Left Hand Rule instead of the vertically oriented forces of the preceding examples. Regardless, in the context of the disconnect switch devices 30 or 50 described, when the conductor 105 corresponds to a location of a switch contact 36 or 38 (FIG. 1) or a switch contact 74 or 76 (FIGS. 2 and 3), as the movable switch contact is opened or closed the force F can deflect the electrical arc 110 when it occurs and considerably reduce arcing time and severity.

Figure 5:
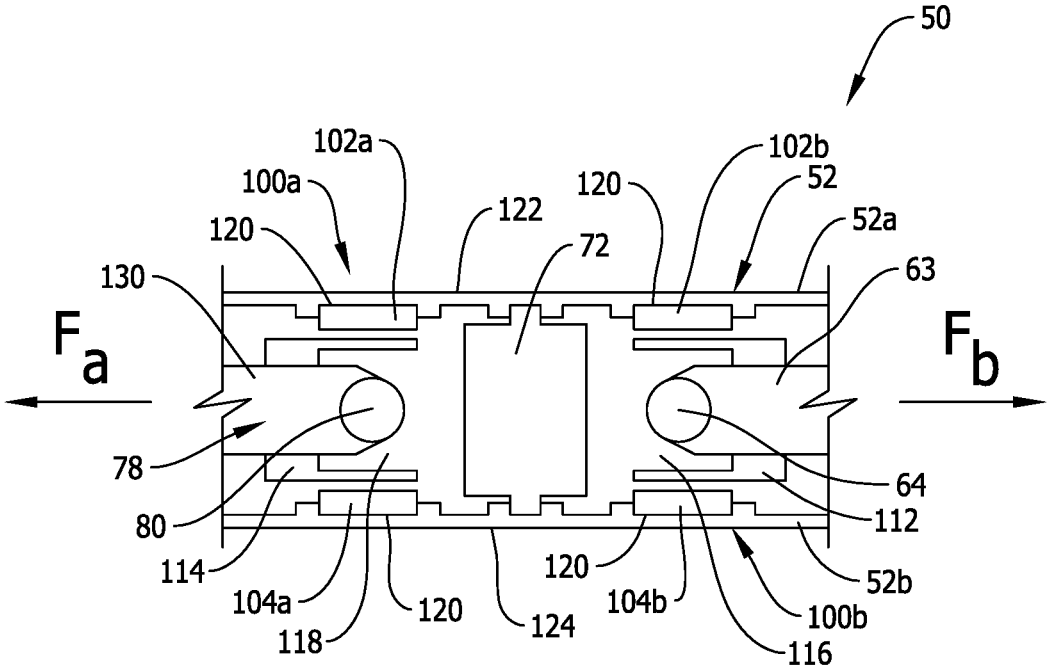
FIG. 5 is a partial top view of the switchable contact assembly for the fusible disconnect switch device shown in FIG. 2.

FIG. 5 is a partial top view of the switchable contact assembly for the exemplary fusible disconnect switch device 50 shown in FIGS. 2 and 3. In the assembly shown in FIG. 5, two magnet assemblies 100*a* and 100*b* are each respectively positioned around separate conductors (e.g., the terminals 78 and 63) having separate switch contacts 80 and 64. Specifically, magnets 102*a* and 104*a* of the first magnetic assembly 100*a* are positioned on either lateral side of the stationary switch contact 80 and the terminal conductor 78 and further are positioned on a first longitudinal side of the sliding actuator bar 72. The magnets 102*b* and 104*b* of the second magnetic assembly 100*b* are located on either lateral side of the stationary switch contact 64 and the terminal conductor 63 to which it is attached and further are positioned on a second longitudinal side of the sliding actuator bar 72 opposite the first longitudinal side.

The polarity of the magnets 102, 104 in each magnet pair 100*a*, 100*b* may be reversed or oppositely directed relative to one another to produce magnetic fields extending in opposing directions and hence generating oppositely directed forces $F_a$ and $F_b$ as determined by the relationship (1) set forth above. For example, the first pair of magnets 102*a*, 104*a* impose a first magnetic field having a first polarity and hence generates a magnetic field acting in a first direction (e.g., toward the top of the page in FIG. 5) as current flows though the contact 80 in a direction extending out of the page of FIG. 5. The second pair of magnets 102*b*, 104*b* may impose a magnetic field having a second polarity and hence generates a magnetic field acting in a second direction (e.g., toward the bottom of the page in FIG. 5) as current flows though the contact 64 in a direction extending into the page of FIG. 5. In accordance with Fleming's Left Hand Rule applied to each contact 80 and 64, the orientation of the magnetic fields in opposite directions, when combined with the induced magnetic fields associated with the current flow in each contact (which as noted above are also opposite directed in each contact 80 and 64), generates the forces $F_a$ and $F_b$ that extend in opposite directions 180° apart from one another as illustrated. An electrical arc occurring at the location of the contact 80 is therefore deflected in a first direction by the force $F_a$ while an electrical arc at the location of the contact 64 is deflected in a second direction by the force $F_b$ that is oriented oppositely to the first direction. The deflection of the arcs at each contact location via the forces $F_a$ and $F_b$ increases arc length and therefor reduces arc intensity and duration. As the movable switch contacts 74, 76 (FIG. 2) are separated from the stationary switch contacts 74 and 80, arc length is also increased and arc intensity is reduced and more quickly dissipates.

Also, and as partly shown in FIG. 5, the arcs may be deflected toward stacked arc plates 112, 114 on each side of the switch assembly proximate each respective contact 64, 80 and the mating contacts 74, 76 (FIG. 2). Each stack of arc plates 112, 114 includes a respective opening or channel 116, 118 on an end thereof facing the respective stationary contact 64, 80. The movable contacts 76, 74 travel through the respective channels 116, 118 along their path of motion as they are moved toward and away from the contacts 80, 74 and 64, 76 within the arc plate channels 116, 118. As the contacts are opened in higher voltage DC circuitry, arcing occurs between the respective contacts 76, 80 and 76, 64. The arc plates 112, 114 provide further arc division by splitting the respective arcs into a series of smaller arcs between the respective plates 112, 114. The arc plates 112, 114 in contemplated embodiments are metal plates that are appropriately vented in any known manner to dissipate electrical arcing and associated heat until the arcing dissipates to the point of cessation. Further reduction in arc energy at each arcing location between the plates 112, 114 is therefore realized, allowing further performance increase when the contacts are switched under higher direct current voltage loads.

The combined effect of the displacement of the switch contacts, the magnetic arc deflecting forces $F_a$ and $F_b$ and arc division over two contact locations, and the arc division at the arc plates effectively facilitates dramatically higher DC voltage operation in a similar size package to existing fusible disconnect switch devices that otherwise could not accommodate the arc energy issues of such higher voltage operation. As such, the compact size of the fusible disconnect switch device 50 is preserved while offering dramatically greater current interruption capability in higher voltage circuitry. The fusible disconnect switch device 50 including the magnets and arc plates described can facilitate, for example, safe and reliable operation of the fusible disconnect switch device 50 in a 1000 VDC power system, about eight times greater than similar sized but conventional fusible disconnect switch devices that are safely and reliably operated in DC voltage systems of 125 VDC or less.

The arrangement shown in FIG. 5 is beneficial in the switch housing 52 because the electrical arc, and associated arc energy, is divided over the two locations of the contacts 80 and 64 and also the arc plates 112, 114 when the movable contacts 74 and 76 are opened and closed, while the magnet assemblies 100*a*, 100*b* act upon the arcing locations in opposite directions with no risk of the arcs at each location combining. It shall be understood, however, that the magnet assemblies 100*a*, 100*b* could be polarized to produce forces $F_a$ and $F_b$ acting in the same direction as long as combining of the arcs could be precluded in another manner, including but not limited to placing arc plates similar to plates 112, 114 at a location between the contacts 64, 80 instead of the arrangement shown in FIG. 5.

While high voltage operation is desirable for certain types of newer, state of the art DC power systems, it is recognized that at lower DC voltage levels, certain of the arc mitigation features described may still be desirably implemented to provide and promote even quicker or more effective arc dissipation than existing devices operated at lower DC voltages. For example, the arc division over two sets of contacts may be omitted in favor of a single set of switch contacts at a lower operating DC voltage, also a single pair of magnets may be used with a single pair of switch contacts with similar effect. At some lower DC operating voltages, a single magnet could likewise be used to provide adequate arc extinguishing performance, either as a stand-alone element or in combination with arc plates. For higher voltage applications, however, the dual pairs of switch contacts, dual pairs of magnets, and arc plates are advantageous as the DC voltage level increases above 125V, and sometimes well above 125 VDC to as much as 1000 VDC.

In contemplated embodiments the magnets 102*a*, 102*b*, 104*a* and 104*b* are permanent magnets, and more specifically are rare earth magnets such as neodymium magnets. In the example of FIG. 5, the magnets 102*a*, 102*b*, 104*a* and 104*b* are embedded in respective interior pockets 120 (also shown in FIG. 6) formed in the opposing sidewalls 122, 124 of the switch housing 52. In contemplated embodiments, the switch housing 52 may be formed as a split casing or from two housing pieces 52*a*, 52*b* that are joined to one another, with the pockets 120 being formed in each piece as shown. The magnets 102*a*, 102*b* are shown in FIG. 5 to extend in a generally coplanar relationship in the housing piece 52*a*, while the magnets 104*a*, 104*b* are shown in FIG. 5 to extend in a generally coplanar relationship in the housing piece 52*b*. The magnets 102*a*, 102*b* respectively extend relative to the magnets 104*a*, 104*b* in a spaced apart but parallel plane so that the magnetic fields are established between the magnets 102*a*, 104*a* and 102*b*, 104*b*.

Figure 6:
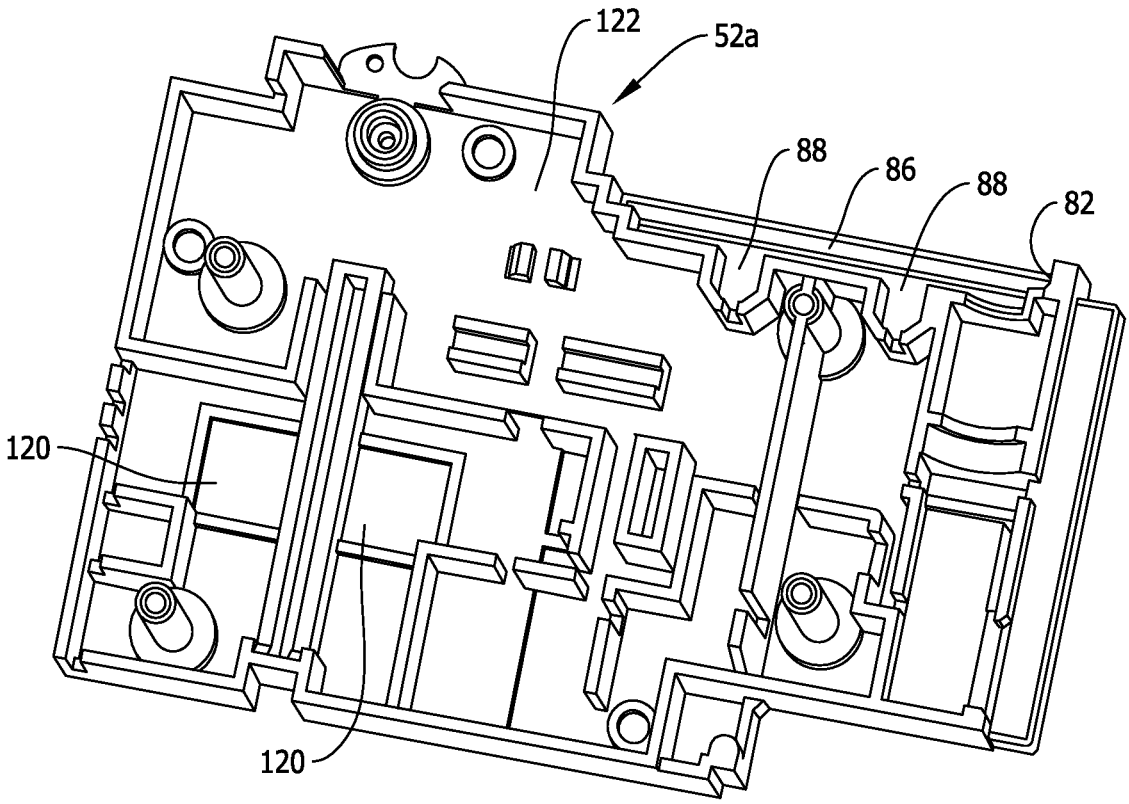
FIG. 6 is a perspective view of an exemplary housing piece for the fusible disconnect switch device shown in FIG. 2.

One of the housing pieces 52*a* is illustrated in FIG. 6 in which the pockets 120 are shown to be formed with and defined by protruding ribs in an injection molded housing piece 52*a*. The second housing piece 52*b* (FIG. 5) is complementary in shape and configuration, including but not limited to being formed with pockets 120 to the housing piece 52*a*. In lieu of ribs, pockets could alternatively be formed and defined with recessed surfaces. The pockets 120 as shown are generally defined to extend parallel to the major surface of the sidewalls 122, 124 of the housing pieces 52*a* and 52*b* such that when the magnets are installed in the pockets 120 the magnets extend generally parallel to the opposing sidewalls 122, 124 of the switch housing 52 as shown in FIG. 5. This too contributes to the compact size of the device 50, although other arrangements are possible.

In combination, the housing pieces 52*a*, 52*b* enclose and protect the internal components shown in FIG. 2 and also the magnets 102*a*, 102*b*, 104*a* and 104*b* described when the housing pieces 52*a*, 52*b* are assembled and fastened together. In another embodiment, pockets similar the pockets 120 shown in FIGS. 5 and 6 may be formed on the exterior of housing pieces 52*a*, 52*b* instead of the interior pockets formed on the interior of the housing pieces as shown in FIGS. 5 and 6 and described above.

The magnets 102*a*, 102*b*, 104*a* and 104*b* may be fastened or secured in place in the pockets 120 in any known manner, and the magnets may be strategically selected in size and type, and also arranged and spaced relative to one another to produce a magnetic field of a desired strength between the magnets in each magnet pair. In general, stronger magnets 102*a*, 102*b*, 104*a* and 104*b* and therefor stronger magnetic fields may be desired as the DC voltage level of the circuit being opened and closed increases through the device 50. The magnets 102*a* and 104*a* used in the first magnet pair 100*a* may be the same or different type as the magnets 102*b* and 104*b* in the second magnet pair 100*b*. Likewise, the magnetic field strength established by the first magnet pair 100*a* may the same or different from the magnet pair 100*b*.

Figure 7:
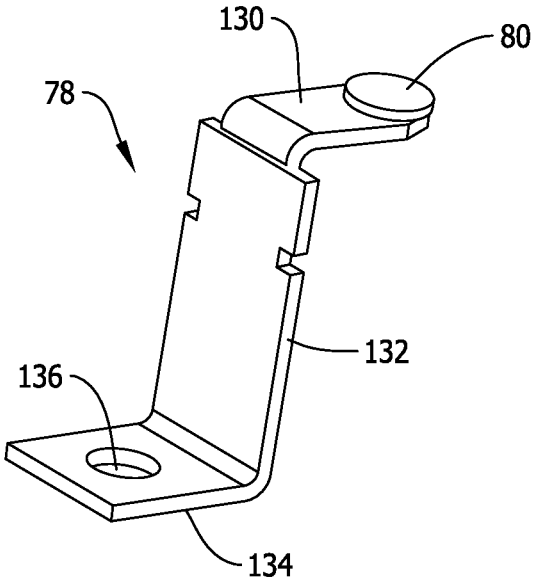
FIG. 7 is a perspective view of an exemplary line-side terminal for the fusible disconnect switch device shown in FIG. 2.

FIG. 7 is a perspective view of the line-side terminal 78 for the fusible disconnect switch device 50 (FIG. 2). The line-side terminal 78 may be formed with a planar upper section 130 to which the contact 80 is attached, an intermediate section 132 extending perpendicular to the upper section 130, and a planar lower section 134 extending perpendicular to the intermediate section 132 and the parallel to the upper section 130. The upper section 130 and the lower section 134, however, extend in opposite directions from the opposing ends of the intermediate section 132. The lower section 134 includes a through-hole 136 that may facilitate attachment of the lower section 136 to a bus-bar, for example at a location exterior to the switch housing 52.

In the arrangement shown in FIGS. 2 and 7, the terminal 78 is configured as a panel clip that facilitates use and attachment of the device 50 with a panelboard. As seen in FIG. 2, the lower section 134 of the panel clip depends from the lower left hand bottom corner of the device 50 and may therefore be recessed in the panelboard assembly while still facilitating convenient installation to the panelboard, while the load-side terminal 66 is elevated in the switch housing 52 relative to the lower section 134 and is also accessible from the side edge of the switch housing to connect a load-side or conductor of the load-side circuit 24. Unlike the connection to the line-side circuit 22 that is made outside the switch housing 52 via the lower section 134, the connection to the load-side circuit 24 is established at a location within the switch housing via the load-side terminal 66. Having the line and load-side terminals of different types and relatively different locations or positions in the switch housing 52 in this example is therefore beneficial for certain panelboard applications. In some embodiments, however, these features may be considered optional.

Figure 8:
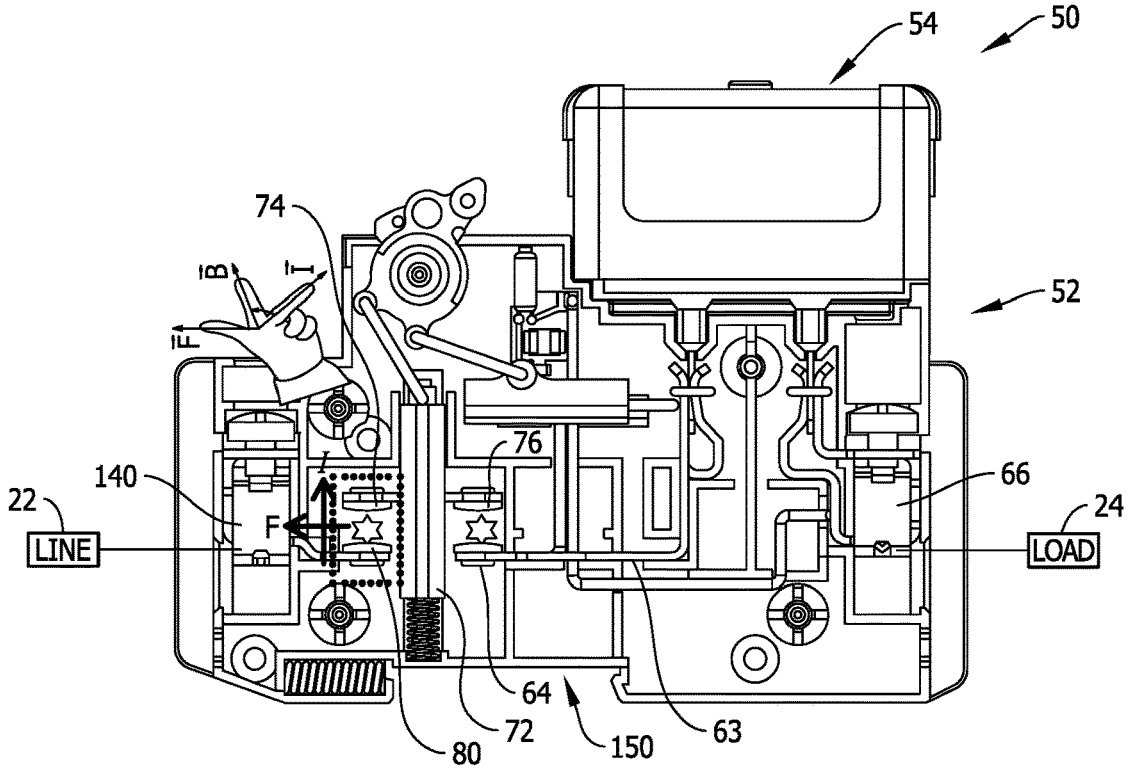
FIG. 8 is a partial longitudinal side elevational view of a second embodiment of a fusible disconnect switch device for the electrical power distribution system shown in FIG. 1.

FIG. 8 is a partial longitudinal side elevational view of a second embodiment of a fusible disconnect switch device 50 for the electrical power distribution system shown in FIG. 1 that is similar to the embodiment described above in relation to FIGS. 2 and 3 in most aspects. The embodiment of FIG. 8 includes a line-side terminal 140 in the form of a box lug terminal that is situated opposite the load-side terminal 66 that is likewise configured as a box lug terminal. Unlike the embodiment shown in FIG. 2, the connections to the line and load-side circuitry 22, 24 are respectively established inside the switch housing 52 on the opposing sides of the device 50, but in similar positions on each side. Various other line and load-side terminal types and positions are possible, however, and may alternatively be utilized.

The switch housing 52 in the embodiment of FIG. 8, unlike the previous embodiments, is configured with a DIN rail slot 150 for ease of installation with a known DIN rail (not shown). That is, the panel mount clip shown in FIGS. 2 and 7 is omitted in favor of the DIN rail slot 150. Other mounting and installation options could be provided in still further and/or alternative embodiments.

The embodiment of FIG. 8 is likewise provided with magnetic arc deflection magnets to produce the force F to deflect an electrical arc toward as described above. In the upper left hand corner of FIG. 8, Fleming's Left Hand Rule is illustrated with the thumb of the hand pointing in the direction of arrow F corresponding to the deflection force generated. Like the previous embodiments, the force F shown in FIG. 8 is directed along an axis that is generally perpendicular to the axis of the sliding bar 72. That is, while the sliding bar 72 moves along a vertical axis in the illustration of FIG. 8, the force F is oriented in a generally horizontal direction, while the magnetic field of the magnets is in this figure oriented into the plane of the page. Optionally, the deflection force may deflect an electrical arc toward stacked arc plates such as the plates 112, 114 described above. Whether or not arc plates are included or not, an alternatively directed arc deflection force F could be established in another direction relative to the axis of the sliding bar 72.

Figure 9:
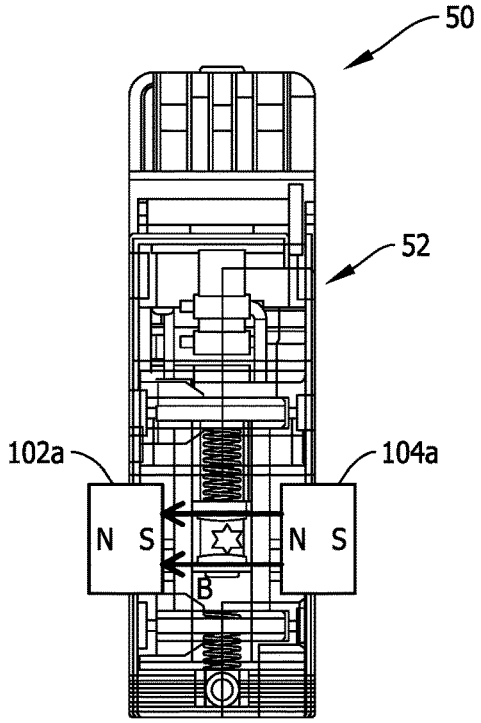
FIG. 9 is a partial lateral sectional view of the fusible disconnect switch device shown in FIG. 8.

FIG. 9 is a partial lateral sectional view of the fusible disconnect switch device 50 shown in FIG. 8. Magnets 102*a* and 104*a* are seen to extend partly inside and partly outside the switch housing 52, but nonetheless operate with similar effect to the embodiments described above to facilitate switching capability at DC voltages of 400 VDC, 600 VDC, and even 1000 VDC.

In certain contemplated embodiments, the magnets 102*a*, 104*a* could be applied entirely outside the switch housing 52 and held in place via magnetic attraction. Some care should be taken, however, if the magnetic strength is insufficient to reliably hold the magnets in place, as the magnetic arc defection could be compromised if the magnets were removed or displaced in a manner that would impair the desired Lorentz force from being established to deflect an arc. While dual magnets are shown, a single magnet could nonetheless impose a magnetic field across the contact assembly to realize at least some of the benefits described.

While an exemplary switch mechanism has been described in the above examples, it is understood that other switch arrangements are possible that may likewise be used in combination with arc deflection plates and magnets to provide still other performance improvements in higher current DC power systems.

Figure 10:
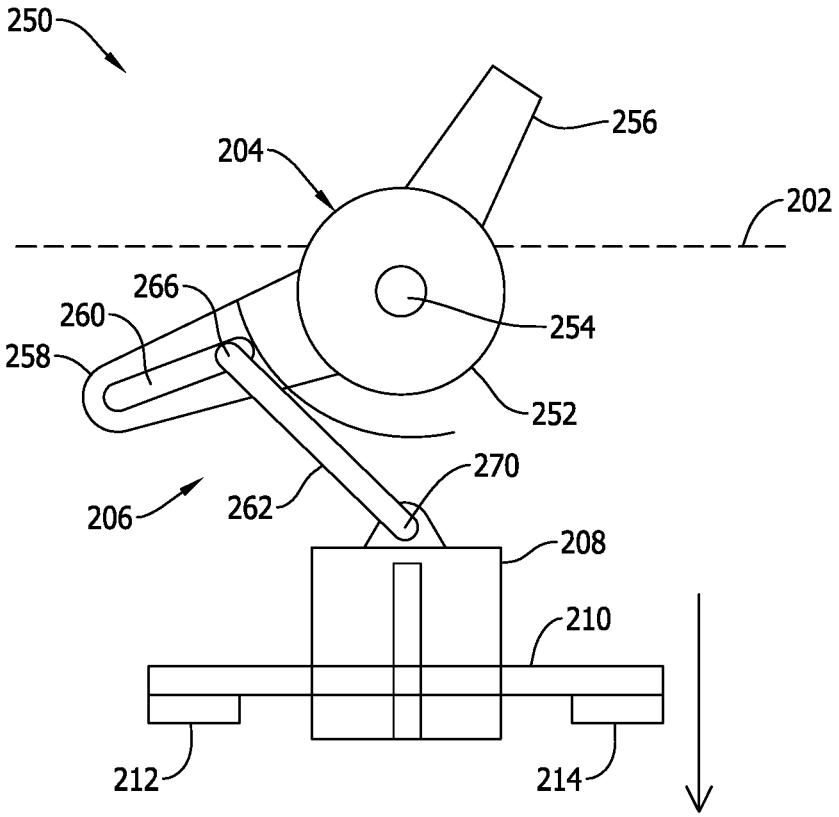
FIG. 10 is a partial illustration of an exemplary linear cam switch mechanism arrangement for a fusible disconnect switch according to the invention.
Figure 11:
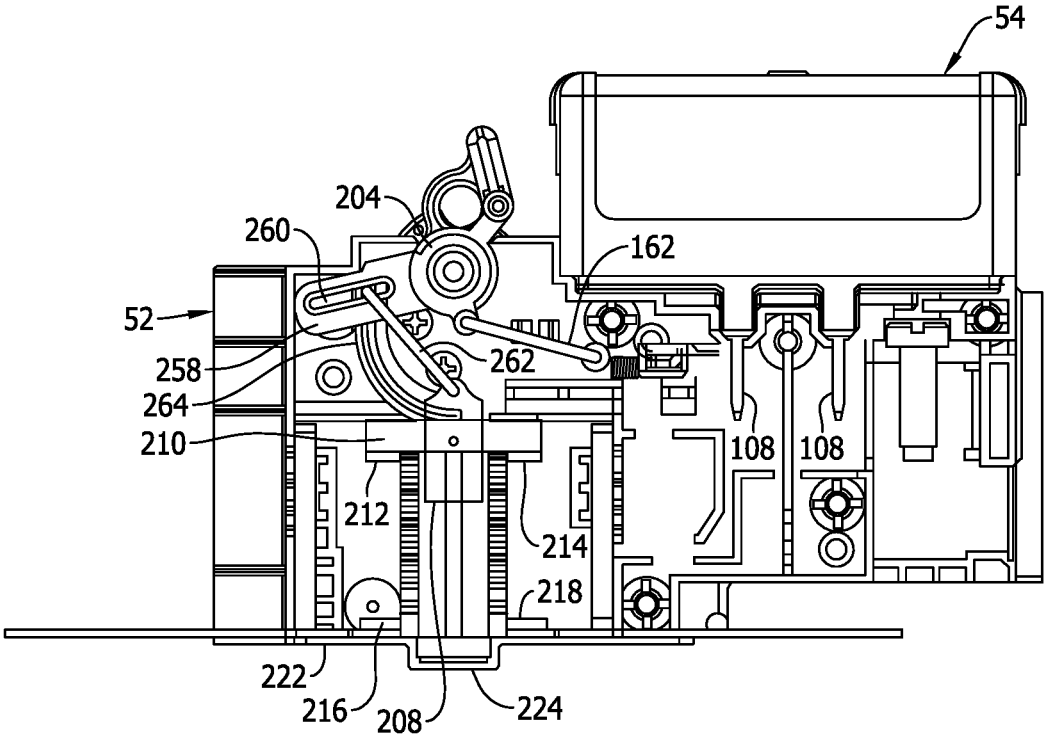
FIG. 11 illustrates the linear cam switch mechanism arrangement of FIG. 10 installed in a disconnect switch device and in an open position.
Figure 12:
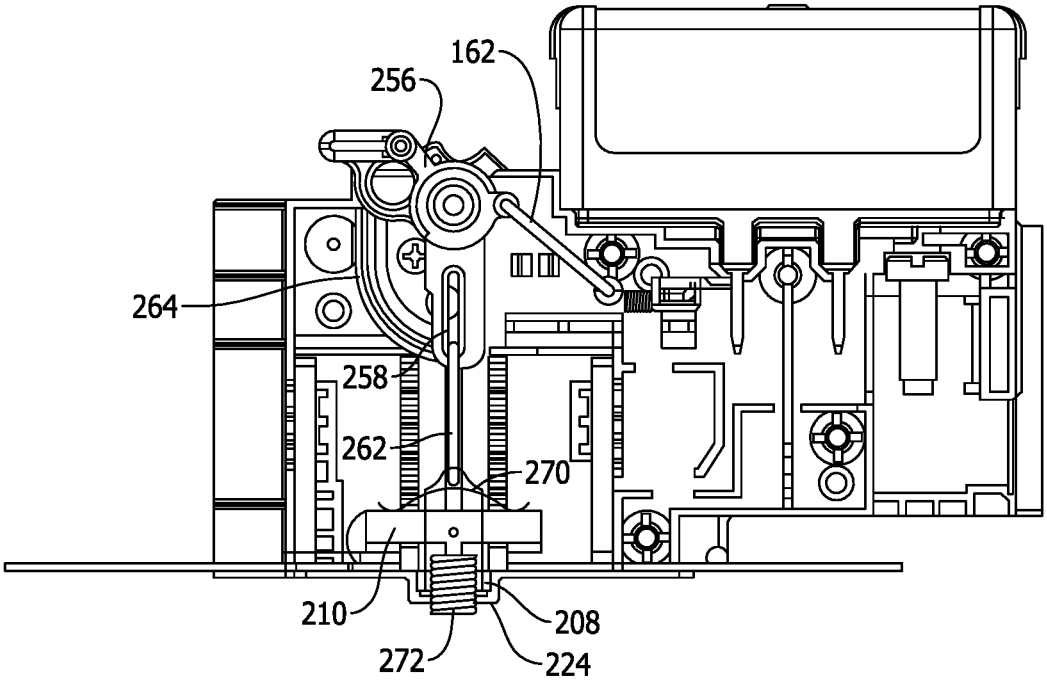
FIG. 12 illustrates the linear cam switch mechanism arrangement of FIG. 10 installed in a disconnect switch device and in a closed open position.

FIG. 10 illustrates an alternative switch mechanism 250 that may be included in the device 50 in the housing 52 in lieu of the switch mechanism described above. FIGS. 11 and 12 illustrate more detailed implementations of the switch mechanism 250 in exemplary embodiments of fusible disconnect switch assemblies. The switch mechanism 250 includes a rotary switch actuator 204 having a round body 252 that is rotatably mounted in the switch housing 52 about a center pin or axle 254. The actuator 204 is formed with a radially extending handle portion 256 that projects from the switch housing 52 when installed, and an elongate link guide member 258 also depends radially from the round body 204 at an oblique angle from the handle portion 256. The elongate link guide member 258 includes an elongated and generally linearly extending slot 260 therein and extending radially from the round body 252 of the actuator 204.

An actuator link or rod 262 is received in the slot 260 and also in a cam surface 264 (FIGS. 11 and 12) via a first end 266 that is bent at a right angle from the longitudinal axis of the link 262. At a second end 270 of the link 262 opposing the first end 266, the link 262 is rotatably mounted to the distal end of a sliding bar 208. The link 262 is generally linear between the two ends 266, 270 and has a length selected, as discussed below, to achieve a desired contact separation of the switch mechanism when opened.

The end 266 of the link 262 may rotate and translate relative to the guide member 258 as it traverses the slot 260 in use, while the end 270 of the link 262 is rotatable, but not translatable, relative to the slider bar 208. In this context, translatable motion of the link end 266 refers to the ability of the link 266 to move closer to or farther away from the axis of rotation of the actuator body 252. In contrast, the end 270 of the link 262 is pinned to the end of the sliding 208 bar and its position along the sliding linear axis is dictated by the sliding bar 208. While the link end 270 can rotate or pivot relative to the slider bar 208, it is incapable of translational movement relative to the slider bar 208.

In FIGS. 10 and 11, the switch mechanism 250 is shown in the open position. The link 262 is accordingly shown in the open position as extending obliquely to the contact element 210 and also to the linear axis of motion of the slider bar 208. By rotating the actuator body 204 in the direction of arrow A, the end 266 of the link 262 is constrained by the slot 260 and the cam surface 264 while the end 270 drives the slider bar 208 and its switch contacts 212, 214 toward corresponding switch contacts 216, 218 in the housing 52. Unlike the contacts 64 and 80 (FIGS. 2, 5 and 8) the contacts 216, 218 are located near the bottom of the housing 52 to facilitate an increased contact separation that may, in turn, reduce arcing severity and duration as the contacts 216, 218 are opened under a higher voltage direct current load.

When fully closed as shown in FIG. 12, the link 262 is oriented generally vertically and assumes a generally perpendicular orientation to the contact element 210 to provide maximum contact force. Alternatively stated, in the closed position the link 262 is generally aligned with the linear axis of the slider bar 208 and maximum contact force is established. The switch actuator 204 can be rotated in the opposite direction to return the mechanism to the open position with the increased contact separation. The switch mechanism operates in reverse as it is opened and closed with the actuator 204.

As shown in FIG. 12 counteracting bias elements such as a leaf spring 270 and a compression spring 272 act on opposing sides of the contact element 210. The leaf spring 270 (shown separately in FIG. 15) provides enhanced contact closing force, while the compression spring 272 provides for enhanced contact opening force. It is understood that in other embodiments, other biasing arrangements are possible, including but not limited to a tension spring in lieu of a compression spring in combination with bias elements other than a leaf spring.

Figure 13:
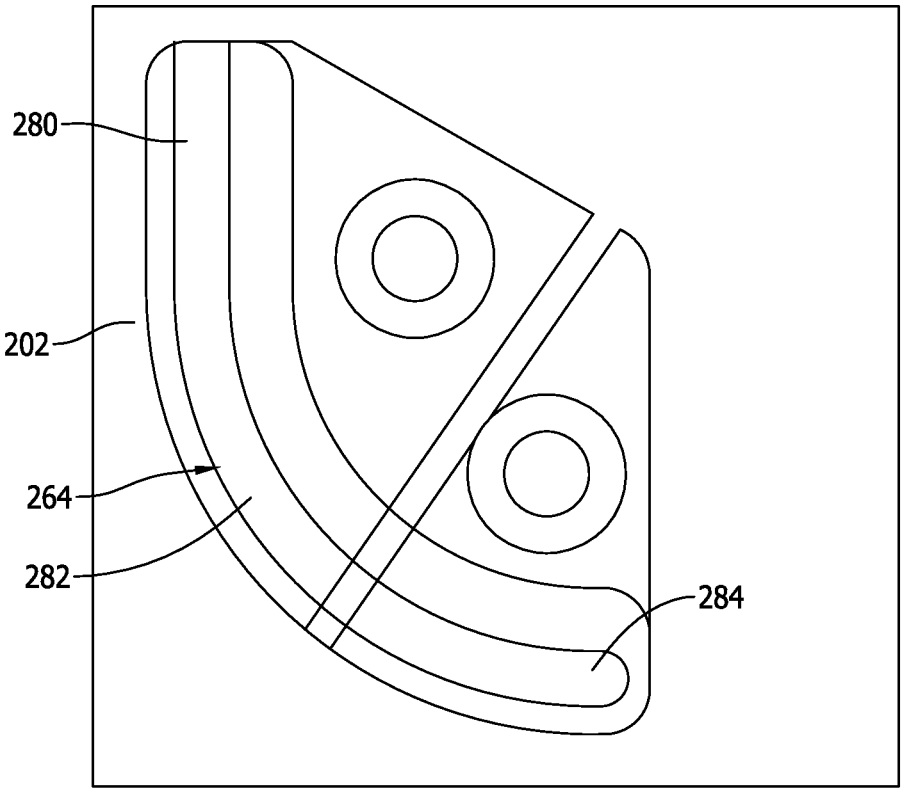
FIG. 13 illustrates a first exemplary cam profile for the linear cam switch mechanism arrangement of FIG. 10.

FIG. 13 illustrates an exemplary cam profile for the cam surface 264. The cam profile is seen to include a linearly extending portion 280 that extends generally vertically or parallel to the vertical axis of movement of the slider bar 208. The linearly extending portion 280 opens to an arcuate portion 282 that completes a substantially 90° arcuate path culminating in a generally horizontally extending portion 284. With the illustrated cam profile, the slider bar 208 is accelerated toward to the stationary contacts as the actual link 262 traverses the cam surface 264 and reduces arcing time as the contact are closed. That is, the velocity of the slider bar 208 as the cam surface 264 is followed is non-uniform to achieve a quicker reduction of the contact gap in first phase of contact closing and slower movement of the slider bar 208 as the contact closing is near completion. Quicker opening or closing of the contacts either breaks or suppresses arcing of a given potential more easily, or provides capability of breaking and suppressing higher intensity arcs than a comparable device without such a cam profile.

Figure 14:
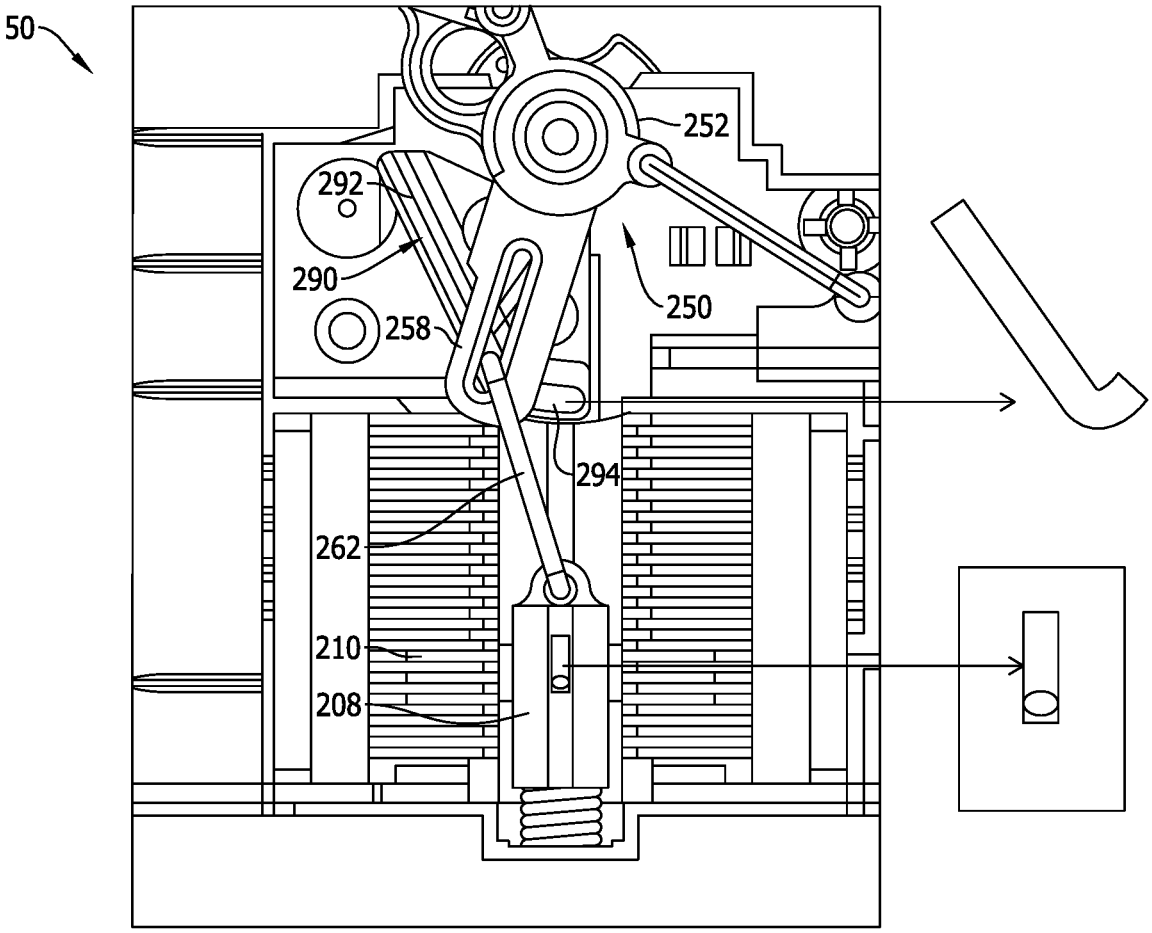
FIG. 14 illustrates a second exemplary cam profile for the linear cam switch mechanism arrangement of FIG. 10.

FIG. 14 illustrates an alternative cam surface 290 for the device 50 and the switch mechanism 250. The cam surface 290 has a profile that includes an elongated and linear extending oblique portion 292 that extends obliquely to the to the vertical axis of movement of the slider bar 208, and an end section 294 that is arcuate. The end section 294 is designed to reach maximum downward displacement of the link 262 at its end 270 about 5° before dead end and then lift the end 270 as it approaches the dead end of the cam surface 290. Advantageously, this cam profile over-compresses the contacts as the mechanism is closed, and then retracts the contacts to produce the desired contact force. The end 270 of the cam profile provides a detent feature that reliably keeps the switch closed in a stable position counteracted by the features described above.

Figure 15:
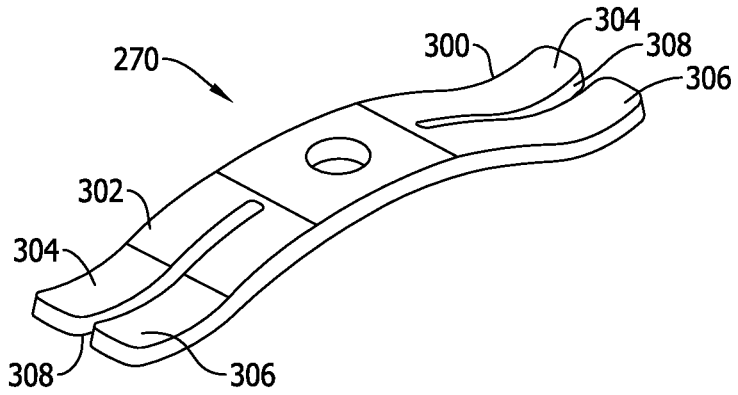
FIG. 15 illustrates an exemplary leaf spring for the switch mechanisms shown in FIGS. 10-14.

FIG. 15 is a perspective view of the leaf spring 270 described in one example. The leaf spring 270 includes forked ends 300, 302 including prongs 304, 306 separated by an opening 308. The dual sets of prongs 304, 306 facilitate the closing of the slider bar including the dual sets of switch contacts 212*a*, 212*b*, 214*a*, 214*b* described above. The material for the leaf 270 spring is selected to provide the closing contact force desired. The leaf spring 270 may be assembled with the actuator link 262 such that downward movement of the link 262 causes the leaf spring 270 to compress and release force as desired to obtain and maintain a desirable amount of contact closing force.

Figure 16:
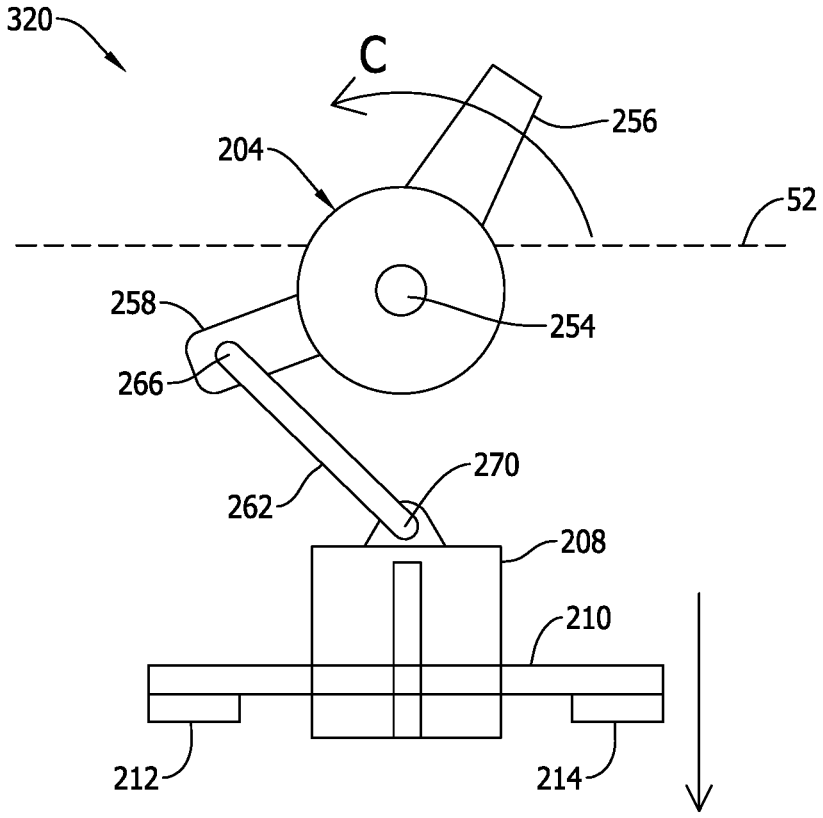
FIG. 16 is a partial illustration of an exemplary linear direct switch mechanism arrangement for a fusible disconnect switch according to the invention.

FIG. 16 illustrates another switch mechanism 320 that can be seen to closely correspond to the mechanism 250 described above, but omits the slot 260 in the guide element 258. As a result, the end 266 of the link 262 can rotate relative to the guide element 258, but it cannot translate relative to the guide element 258. As such, in this arrangement the link 262 is not compatible with the cam surface described above and the housing 52 accordingly does not include a cam surface. The arrangement shown in FIG. 16 is sometimes referred to as a direct linear switch mechanism. Coupled with the dual contact bar element 210 and the dual sets of switch contacts, the direct linear mechanism can effectively make and break electrical connections without excessive arcing at comparatively lower cost than the linear cam switch arrangement described above. Opened and closed positions of the switch contacts are obtained by rotating the switch actuator in opposite directions to raise or lower the slider bar 208.

Figure 17:
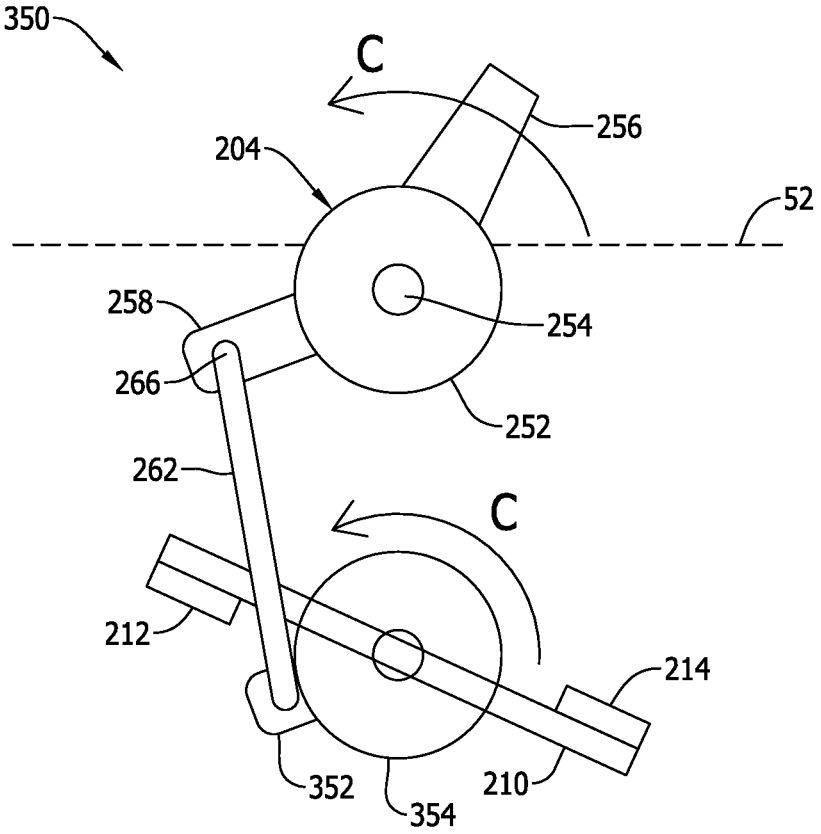
FIG. 17 is a partial illustration of an exemplary rotary switch mechanism arrangement for a fusible disconnect switch according to the invention.
Figure 18:
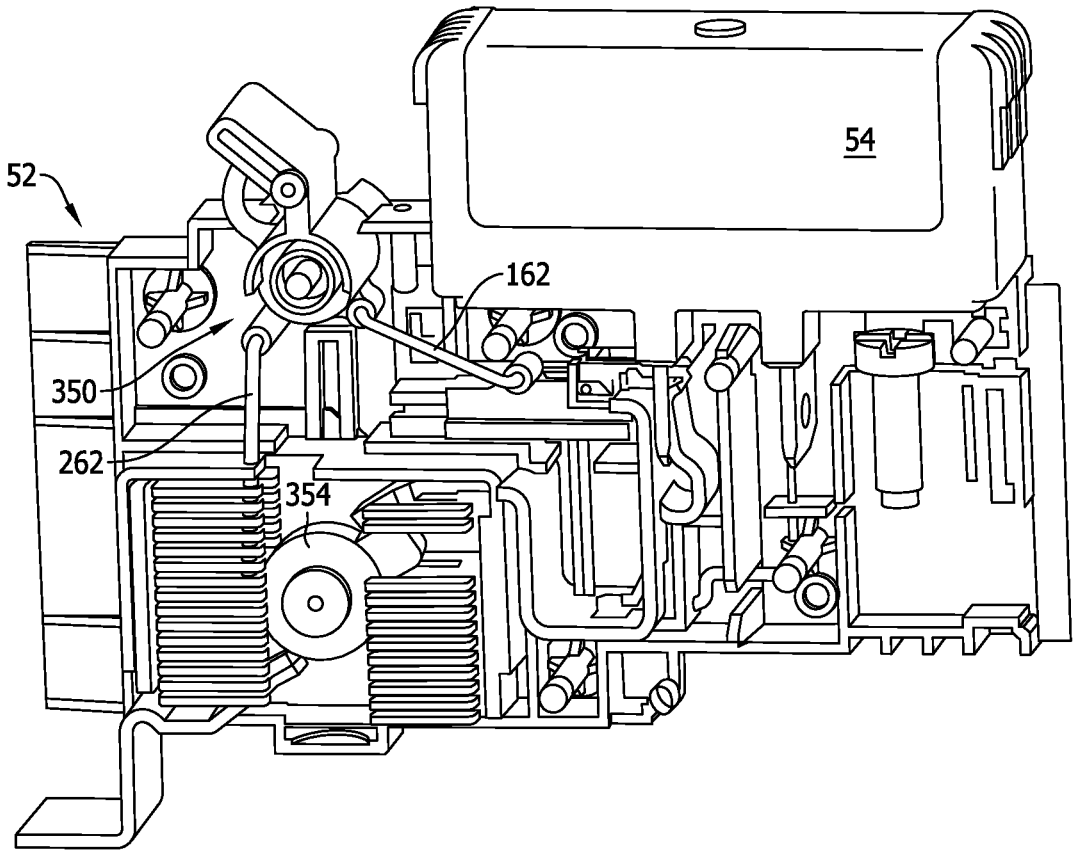
FIG. 18 is a partial illustration of the rotary switch mechanism installed in a disconnect switch device and in a closed position.
Figure 19:
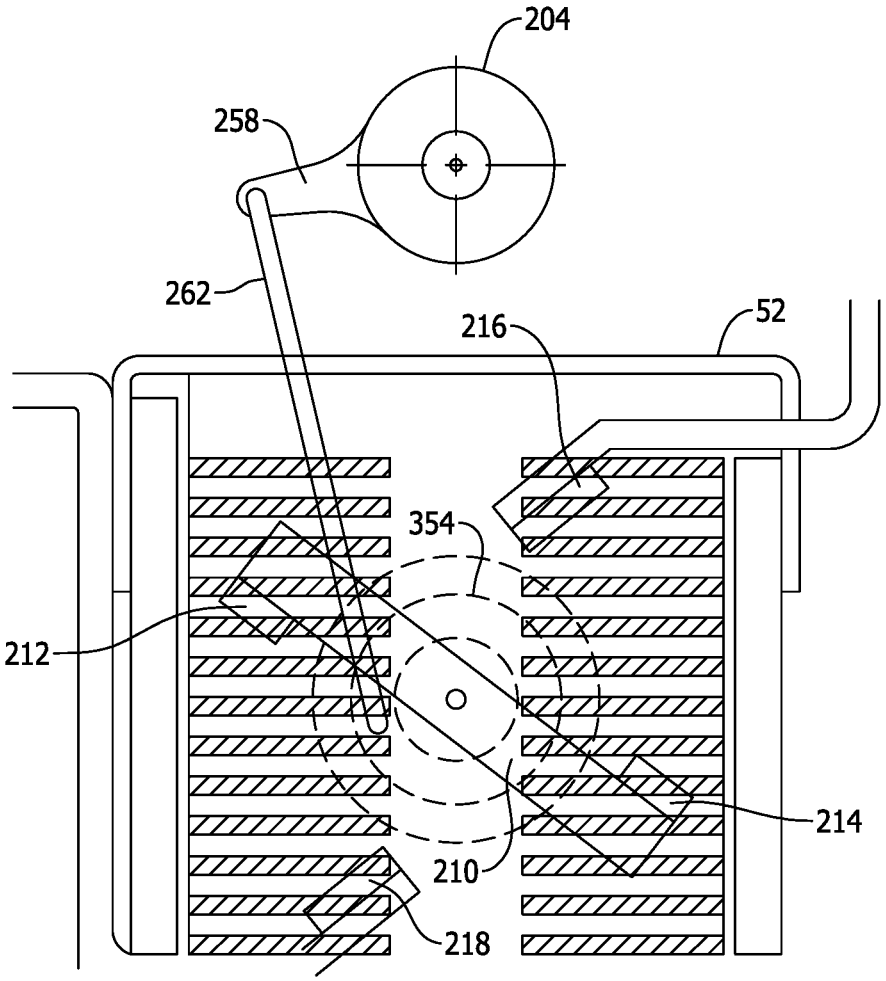
FIG. 19 is a partial illustration of the rotary switch mechanism installed in a disconnect switch device and in an opened position.

FIG. 17 illustrates another switch mechanism 350 for the device 50 that is a rotary switch mechanism. In this switch mechanism, the link 262 is coupled to the guide element 258 at the end 266 and is coupled to an extension 352 of a rotary contact member 354 to which the contact element 210 is attached. Unlike the previously described embodiments, the movable contacts 212, 214 are coupled to opposing sides of the contact element 210 and thus face in opposite directions. The rotary contact member 354 is rotatably mounted in the switch housing 52 at a distance from the switch actuator 204, and by virtue of the link 262 when the switch actuator 54 is rotated in the direction of arrow A the rotary contact member 354 is likewise rotated in the same direction. Since the contact element 52 rotates with the rotary contact member 354 the switch contacts 212, 214 (actually 212*a*, 212*b* and 214*a*, 214*b* by virtue of the dual bar contact element 210) may be engaged and disengaged from the stationary switch contacts 216, 218 (actually 216*a*, 216*b*, 218*a*, 218*b*) as shown in FIG. 6. The rotary mechanism is shown in a closed position in FIG. 18 and in an open position in FIG. 19. The opened and closed positions are obtained by rotating the switch actuator 204 in different directions. For certain applications, the rotary switch mechanism may provide additional space savings and offer further reduction in the housing size than the previously described switch mechanisms. The arcuate or curved paths of motion in the rotary mechanism described facilitates a desired contact separation in a reduced amount of space as compared to the other mechanism described above wherein the movable contacts extend along linear paths of motion.

Figure 20:
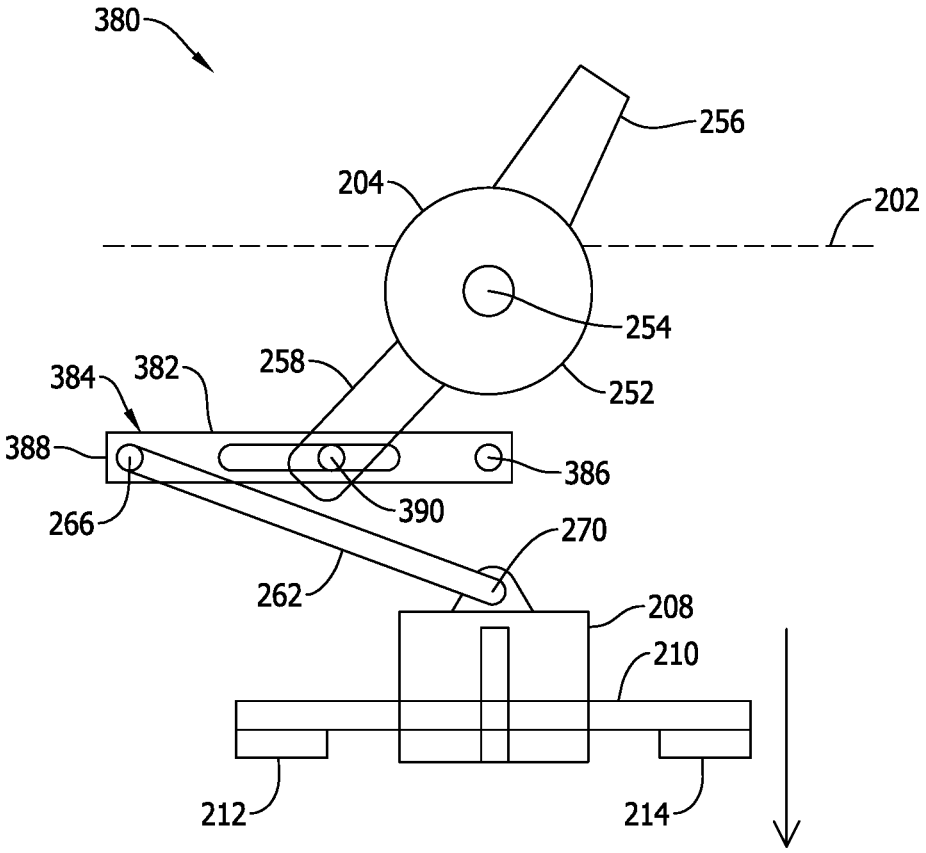
FIG. 20 is a partial illustration of an exemplary linear double rocker switch mechanism arrangement for a fusible disconnect switch according to the invention.
Figure 21:
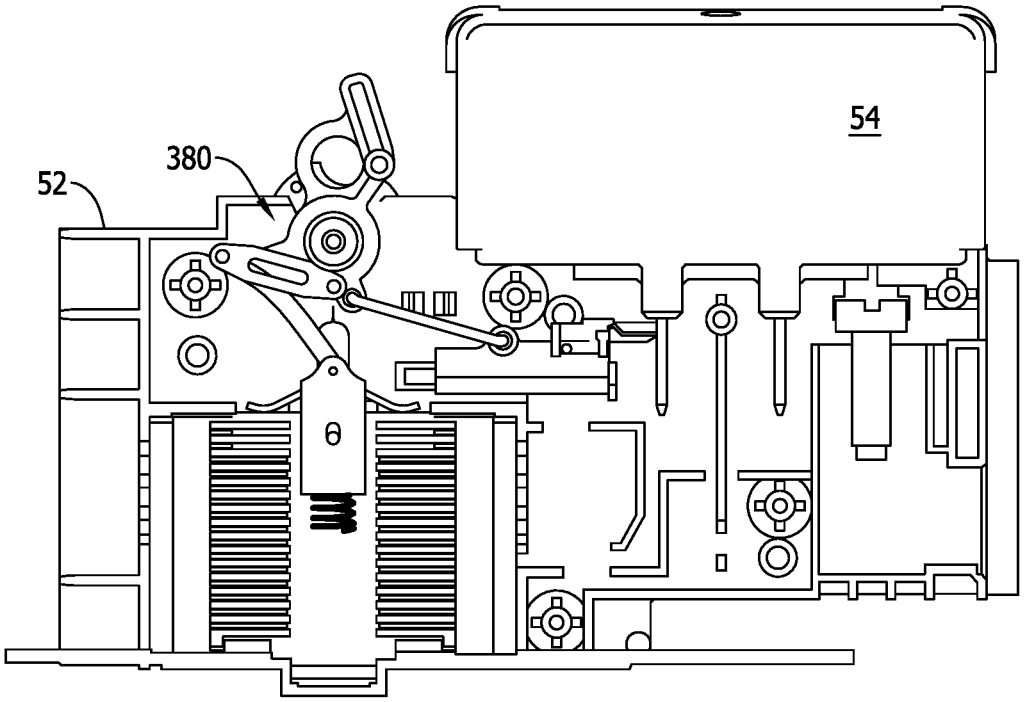
FIG. 21 is a partial illustration of the linear double rocker switch mechanism installed in a fusible disconnect switch device and in an opened position.

FIG. 20 illustrates another switch mechanism 380 for the device 50 that is a rocker switch mechanism. In this arrangement, the guide member 258 of the switch actuator 204 is interfaced with a linear slot 382 of a rocker element 384. The rocker element 384 is rotatably mounted in the housing 52 at a first end 386, and attaches to the end 266 of the link 262 at its opposite end 388. The guide member 258 may include a pin 390 that engages the slot 382 in the rocker element 384. When the switch actuator 204 is rotated in the direction of arrow A. the pin 390 that is constrained to the slot 382 causes the rocker element 384 to pivot about the end 386 in the same direction as arrow A. As the rocker element 384 pivots, the link 262 drives the slider bar 208 downward to close the switch contacts. FIG. 21 shows a more detailed implementation of the mechanism 380 in an opened position. The closed and opened positions are obtained by rotating the switch actuator 204 in opposite directions.

Figure 22:
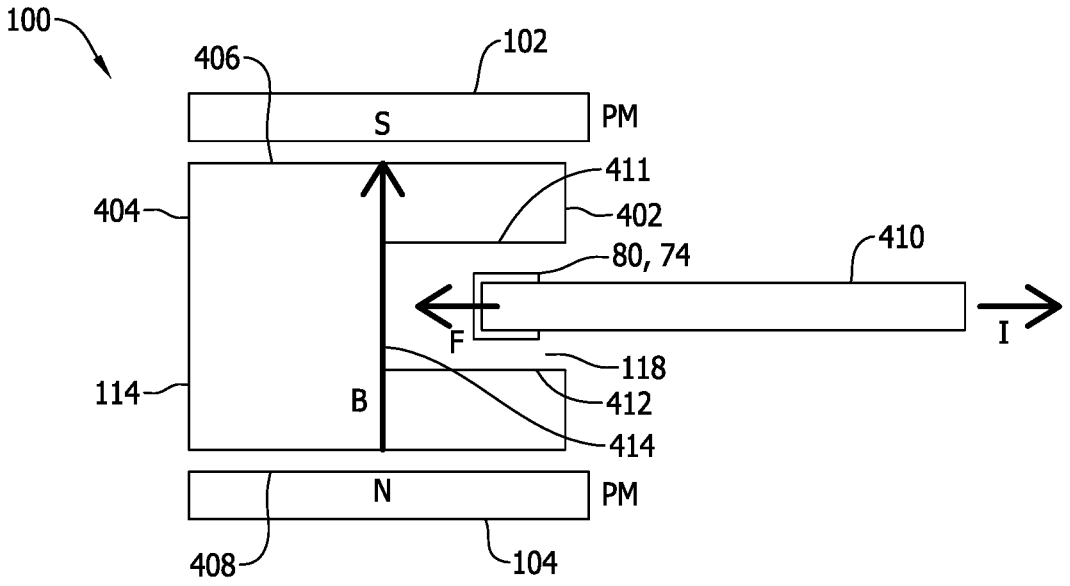
FIG. 22 illustrates a top plan view of a first magnetic arc deflection assembly according to one embodiment of the present invention.

FIG. 22 illustrates a top plan view of a first magnetic arc deflection assembly 100 for a switch mechanism and device such as those described above according to one embodiment of the present invention. The assembly 100 shown in FIG. 22 may be recognized as a portion of the arrangement shown in FIGS. 4 and 5 including spaced apart permanent magnets 102, 104 on opposing side edges of arc plates 114, that it turn define a channel 118 through which the movable contact (e.g., the movable contact 74 (FIG. 5)) may travel along its path of motion between the opened and closed positions relative to the stationary contact 80. While not shown in FIG. 22, a mirror image arrangement of magnets and arc plates 112 is duplicated for the contacts 64, 76 in the device 50 with similar benefit. The arm 410 shown in FIG. 22 is an electrical conductor that facilitates current flow I between the switchable contacts 74 and 76. As contemplated above, however, the second set of switch contacts (e.g., the contacts 76, 64) may be considered optional in some embodiments and may accordingly be omitted.

In the example of FIG. 22, the arc plates 114 are shown as generally flat and planar elements each having lateral edges 402, 404 and longitudinal edges 406, 408 interconnected with one another in a generally orthogonal relation and defining a generally rectangular outer periphery of the arc plates 114. The longitudinal edges 406, 408 extend generally parallel to one another and to the longitudinal axis of the conductor arm 410 and the corresponding longitudinal axis of the switch housing 52. The lateral edges 402, 404 extend generally parallel to one another and to the lateral axis of the conductor arm 410 and the corresponding lateral axis of the switch housing 52 as best seen FIG. 5.

The leading edge 402 that faces the contacts 80, 74 and the channel 118 is formed as a generally U-shaped opening in the leading edge 402. The U-shaped opening has longitudinal side edges 411, 412 extending parallel to one another on opposing lateral sides of the contacts 80, 74, and a lateral side edge 414 inwardly spaced from the leading longitudinal edge 402 of the plate 114. The channel 118 defined by the edges 411, 412, 414 is recessed from the leading edge 402 and generally surrounds the contacts 80, 74 on three sides. Opposite the leading edge 402 is a second edge 404 that is straight and parallel to the leading edge 402 without an opening formed therein. While an exemplary geometry of plates 114 is shown and described, alternative geometric arrangements are possible in other embodiments.

The magnets 102, 104 are arranged in a generally parallel position to one another in a slightly spaced relation from the side edges 406, 408 of the plates 114. As such, the plates 114 are sandwiched between the magnets 102, 104, and the magnets 102, 104 produce a magnetic field B across the plane of the plates 114 and in a direction perpendicular to the current flow between the contacts 80, 74 as the movable contact 74 is separated from the stationary contact 80. Assuming that a direction of current flow between the contacts 74, 80 as this occurs is perpendicular to the plane of the page of FIG. 22 and also extends out of the plane of the page of FIG. 22, application of the principles above shows that an arc deflecting force F is produced that deflects the arc in the longitudinal direction toward the arc plates 114, and more specifically toward the edge 414 of the channel 118 in the plates 114. Electrical arcing is divided by the plates 414 and weakened, safely and effectively dissipating arc energy and heat until the arcing is extinguished between the contacts 74, 80. Heat generated by the arcing and its dissipation is vented between the plates 114 and/or alongside the plates 114 in the switch housing 52.

The arrangement shown in FIG. 22 accordingly facilitates satisfactory operation of the switch mechanism under higher voltage DC loads exceeding 125 VDC, although it should be noted that the arrangement of FIG. 22 is polarity dependent in order to do so. If the direction of current flow I was reversed through the contacts 74, 80 the direction of the arc deflection force F shown in FIG. 22 would be reversed such that the electrical arcing would undesirably be deflected out of the channel 118 and away from the arc plates 114 such that the arc plates 114 would not provide the desired effect. Considering a dual switch contact arrangement like that of FIG. 5, reversal of the current would produce inwardly directed are deflection forces $F_a$ and $F_b$ instead of the outwardly directed forces desired. Inwardly directed arcs would tend to accelerate degradation of the switch mechanism rather than to protect it from the increased energy of higher voltage DC circuitry, and accordingly a device in including the assembly 100 requires careful installation and connection to the circuit with the proper polarity for the switch mechanism to perform as designed.

Figure 23:
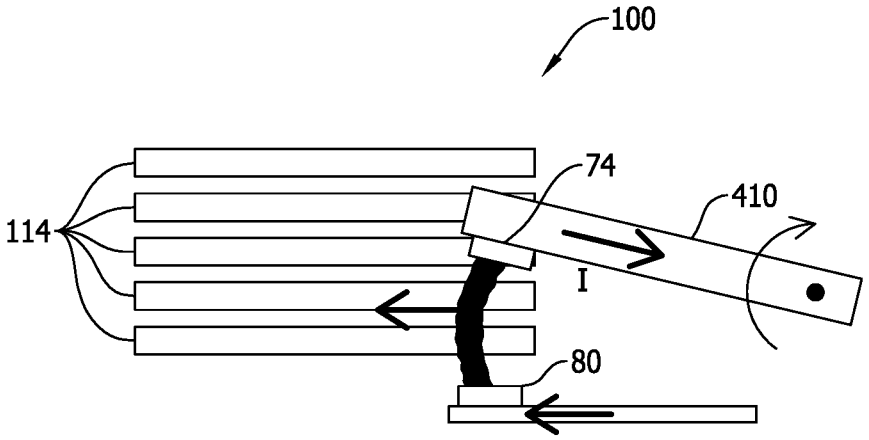
FIG. 23 is a side elevational view of the magnetic arc deflection assembly shown in FIG. 22.

FIG. 23 is a side elevational view of the magnetic arc deflection assembly shown in FIG. 22 with the contacts 74, 80 partly separated and with electrical arcing therebetween. The arc is seen to be deflected by the force F toward the plates 114 to facilitate the described arc division and energy dissipation. As the arc length between the contacts 80, 74 increases the arc severity eventually decreases to the point that the arc can no longer sustain itself, while the plates 114 help to dissipate the arc energy until that point occurs. FIG. 23 shows this to be true whether or not the switchable contact 74 traverses a linear path of motion as in some of the switch mechanisms described above, or whether the contact 74 traverses an arcuate path of motion as in some of the switch mechanisms described above (e.g., the rotary switch contacts in the mechanism of FIGS. 17-19. As such, the arrangement shown can be effectively used with all of the switch mechanisms described above, provided that the device including the magnetic arc deflection arrangement is connected to the line and load circuitry 22, 24 (FIG. 1) with the line-side terminal described connected to the line circuitry 22 and the load-side terminal described connected to the load circuitry 24. That is, the arrangement of FIGS. 22 and 23 requires that the line terminal is the input terminal for the device and the load terminal is the output terminal for the arc deflection functionality to work as designed.

Figure 24:
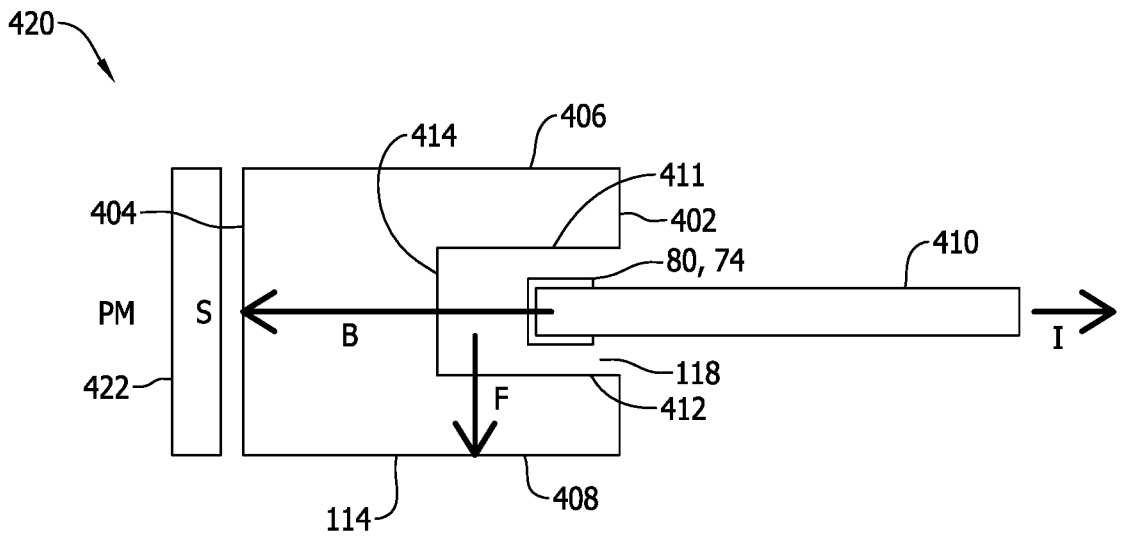
FIG. 24 illustrates a top plan view of a first magnetic arc deflection assembly according to another embodiment of the present invention.

FIG. 24 illustrates a top plan view of a second magnetic arc deflection assembly 420 according to another embodiment of the present invention. Unlike the arrangement of the assembly 100 shown in FIG. 22, the arrangement of the assembly 420 shown in FIG. 24 includes a single permanent magnet 422 adjacent the lateral edge 404 of the arc plates 114 at a location opposite the leading edge 402 and the channel 118. The single magnet 422 applies a magnetic field B in a longitudinal direction toward the magnetic plates 114. Comparing FIGS. 24 and 22, the magnetic field B in FIG. 24 is oriented generally parallel to the longitudinal axis of the moving arm 410 and current flow I there through, whereas the magnetic field B in FIG. 22 is generally perpendicular to the longitudinal axis of the moving arm. In other words, the arc deflection force F produced by the arrangement of FIG. 24 is perpendicular to the arrangement shown in FIG. 22. Consequently, the arc defection force F in the arrangement of FIG. 24 is longitudinally directed vis-à-vis the longitudinal axis of the moving arm 410, whereas in the arrangement of FIG. 22 the arc deflection force F produced is directed laterally directed vis-à-vis the axis of the moving arm 410. The arc deflection force F in FIG. 24 is directed toward the side edge 412 of the channel 118 in the arc plates 114 rather than to the edge 414 of the channel 118 in the arrangement of FIG. 22.

The arrangement of FIG. 24 may sometimes be preferred over the arrangement of FIG. 22 because it is not polarity dependent like the arrangement of FIG. 22. It should be evident from FIG. 24 that if the direction of current flow I was reversed, the arc deflection force would also reverse in direction but would still deflect any arcing into the arc plate 114 at the edge 411 of the channel 118. As such, the arrangement of FIG. 24 works with equal effectiveness even if the load-side terminal described is used as the input terminal to connect the device to the line circuitry 22. Advantageously, an installer need not be concerned about polarity when installing the device including the magnetic arc deflection assembly 420 of FIG. 24.

Figure 25:
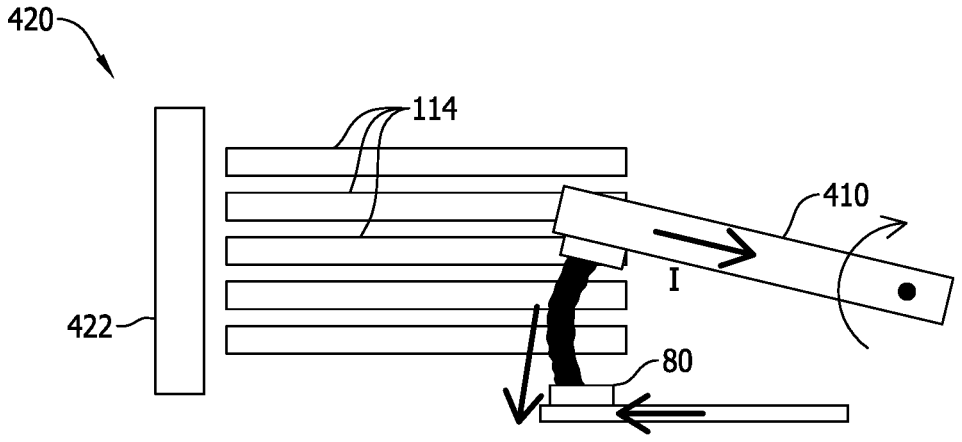
FIG. 25 is a side elevational view of the magnetic arc deflection assembly shown in FIG. 22.

FIG. 25 is a side elevational view of the magnetic arc deflection assembly 420 shown in FIG. 24. Arcing that occurs between the contacts 74, 80 is deflected normal to the plane of the page of FIG. 25 and with the current flow shown is deflected out of the plane of the page. If the current flow was reversed arcing would be deflected into the plane of the page, but either way the deflected arcs interface with the arc plates 114 in the same manner but along different edges of the channel as described above. Heat generated by the arcing and its dissipation is vented between the plates 114 and/or alongside the plates 114 in the switch housing 52. FIG. 25 shows that the arrangement is effective whether or not the switchable contact 74 traverses a linear path of motion as in some of the switch mechanisms described above, or whether the contact 74 traverses an arcuate path of motion as in some of the switch mechanisms described above (e.g., the rotary switch contacts in the mechanism of FIGS. 17-19. As such, the arrangement shown can be effectively used with all of the switch mechanisms described above The benefits and advantages of the inventive concepts are now believed to have been amply illustrated in relation to the exemplary embodiments disclosed.

An embodiment of an electrical disconnect device has been disclosed including a nonconductive housing and a current path defined in the nonconductive switch housing. The current path includes a switch mechanism comprising a first switch contact mounted stationary in the nonconductive switch housing, a movable arm provided with a second switch contact, the movable arm selectively positionable between an opened position and a closed position to cause the second switch contact to travel along a path of motion to connect or disconnect the switch contacts and accordingly complete or open the current path in the nonconductive housing, a first stack of arc plates including a leading edge defining a channel through which the path of motion of the second switch contact passes, and a first magnet establishing a magnetic field across the stack of arc plates.

Optionally, the switch mechanism may also include a second magnet spaced apart from the first magnet with the first stack of arc plates extending between the first and second magnets. The first magnet may be arranged on an edge of the first stack of plates opposite to the leading edge. The path of motion of the second switch contact may be linear. Alternatively, the path of motion of the second switch contact may be arcuate.

As further options, the switch mechanism may further include a third switch contact mounted stationary in the nonconductive switch housing, a fourth switch contact provided on the movable arm and in series with the second switch contact, the fourth switch contact movable along a path of travel toward and away from the third switch contact, a second stack of arc plates including a leading edge defining a channel through which the path of motion of the fourth switch contact passes, and at least a second magnet establishing a magnetic field across the second stack of arc plates. The first and second magnetic fields and the arc plates may be selected to dissipate electrical arc energy when the second and fourth switch contacts are opened under a direct current load of 125 VDC to about 1000 VDC.

Also optionally, the current path may include first fuse contact member and a second fuse contact member configured to receive an overcurrent protection fuse. The overcurrent protection fuse may include a pair of terminal blades insertable into the nonconductive housing along an insertion axis, and the first fuse contact member and the second fuse contact member receiving a respective one of the pair of terminal blades. The current path not include a circuit breaker.

As still further options, the movable arm may define a longitudinal axis, and the arc deflection force may be generated perpendicular to the longitudinal axis. The disconnect device may be one of a circuit breaker device, a contactor device and a fusible disconnect switch device.

An embodiment of an electrical disconnect switch device has also been disclosed including a nonconductive switch housing, and a current path defined in the nonconductive switch housing. The current path includes a switch mechanism including a first terminal member connectable to a power supply circuit, a first switch contact provided on the first terminal member and mounted stationary in the nonconductive switch housing, a movable arm provided with a second switch contact, and a second terminal connectable to an electrical load circuit. The movable arm is selectively positionable between an opened position and a closed position to cause the second switch contact to travel along a path of motion toward and away from the first switch contact to connect or disconnect the first and second terminal members and accordingly complete or open the current path in the nonconductive switch housing. The switch mechanism also includes a first stack of arc plates including a leading edge defining a channel through which the path of motion of the second switch contact passes, and a first magnet establishing a magnetic field across the first stack of arc plates. When the movable arm is in the closed position under a direct current voltage electrical load the magnetic field produces an arc deflecting force as the second switch contact is being separated from the first switch contact to move the moving arm to the opened position.

Optionally, the disconnect switch device may also include a second magnet arranged opposite the first magnet with the first stack of arc plates extending between the first and second magnets. The first magnet may be arranged on an edge of the stacked arc plates opposite of the leading edge. The path of motion of the second switch contact may be one of a linear path or an arcuate path. The switch mechanism may also further include a third switch contact mounted stationary in the nonconductive switch housing, a fourth switch contact provided on the movable arm and movable along a path of travel toward and away from the third switch contact, a second stack of arc plates including a leading edge defining a channel through which the path of motion of the fourth switch contact passes, and at least a second magnet establishing a magnetic field across the second stack of arc plates. The current path may also include a first fuse contact member and a second fuse contact member configured to receive an overcurrent protection fuse.

An embodiment of a fused disconnect switch has also been disclosed including a nonconductive housing defining a fuse receptacle, a line-side terminal in the nonconductive housing and including a first stationary contact, a line-side fuse terminal including a second stationary contact and a movable arm carrying first and second movable switch contacts. The first and second switch contacts complete an electrical path from the line-side terminal to the line-side fuse terminal when the switch is in the closed position and disconnecting the line-side contact from the line-side fuse terminal when the switch actuator is in the opened position. The fused disconnect switch also includes a first stack of arc plates proximate the first movable switch contact and a second stack of arc plates proximate the second movable switch contact, wherein the first and second stack of arc plates respectively includes a leading edge defining a channel through which the respective path of motion of the first and second movable switch contact passes. A first magnet establishing a first magnetic field across the first stack of arc plates, and a second magnet establishing a second magnetic field across the second stack of arc plates are also provided.

Optionally, the first and second magnetic fields are sufficient in strength to produce respective arc deflecting forces in the respective direction of the first and second stack of arc plates to dissipate electrical arcing under a direct current voltage load exceeding 125 VDC.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compact electrical switch device comprising:

a nonconductive housing having opposed first and second sides;

a line-side input connecting terminal accessible from the first side to establish a connection to line-side circuitry of an electrical power system;

a load-side output connecting terminal accessible from the second side to establish a connection to load-side circuitry;

a current path defined internal to the nonconductive housing from the line-side input connecting terminal to the load-side output connecting terminal, the current path comprising:

a first switch contact mounted stationary inside the nonconductive housing; and a rotatable arm provided with a second switch contact, the rotatable arm selectively positionable relative to the nonconductive housing between an opened position and a closed position to cause the second switch contact to travel along an arcuate path of motion and obtain a contact separation selected to disconnect higher voltage DC circuitry in the current path, wherein the higher voltage DC circuitry has a voltage higher than 125 VDC;

a first plurality of stacked arc plates inside the nonconductive housing and extending substantially parallel to one another, each of the first plurality of stacked arc plates including a leading edge defining a channel extending uniformly through the first plurality of stacked arc plates and also through which the arcuate path of motion of the second switch contact passes, each of the first plurality of stacked arc plates further including a second edge opposite the leading edge and generally parallel to the leading edge, each of the first plurality of stacked arc plates further including longitudinal edges generally perpendicular to the leading edge and the second edge; and a first magnet establishing a magnetic field across the first plurality of stacked arc plates and through the arcuate path of motion of the second switch contact, wherein the first magnet is arranged on the second edge of the first plurality of stacked arc plates, and an arc deflection force generated by the first magnet is directed towards a longitudinal side edge of the channel that is generally perpendicular to the leading edge, wherein the compact electrical switch device does not include a circuit breaker, and the compact electrical switch device does not include a magnet positioned generally parallel to the longitudinal edges of the first plurality of stacked arc plates.

2. The compact electrical switch device of claim 1, further comprising:

a third switch contact mounted stationary inside the nonconductive housing;

a fourth switch contact provided on the rotatable arm and in series with the second switch contact, the fourth switch contact movable along an arcuate path of motion toward and away from the third switch contact;

a second plurality of stacked arc plates extending inside the nonconductive housing and substantially parallel to one another, each of the plurality of stacked arc plates including a leading edge defining a channel extending uniformly through the second plurality of stacked arc plates and also through which the arcuate path of motion of the fourth switch contact passes; and at least a second magnet establishing a magnetic field across the second plurality of stacked arc plates and through the arcuate path of motion of the fourth switch contact.

3. The compact electrical switch device of claim 2, wherein the contact separation, the first and second magnetic fields, and the first and second plurality of stacked arc plates are selected to dissipate electrical arcing energy when the second and fourth switch contacts are opened under higher voltage DC circuitry presenting a direct current load of 125 VDC to about 1000 VDC.

4. The compact electrical switch device of claim 1, wherein the current path further comprises a first fuse contact member and a second fuse contact member in the nonconductive housing, the first fuse contact member and the second fuse contact member each being configured to receive respective terminal elements of an overcurrent protection fuse.

5. The compact electrical switch device of claim 4, wherein the terminal elements of the overcurrent protection fuse comprise a pair of terminal blades insertable into the nonconductive housing along an insertion axis, and the first fuse contact member and the second fuse contact member receiving a respective one of the pair of terminal blades.

6. The compact electrical switch device of claim 1, wherein the rotatable arm defines a longitudinal axis, and wherein the first magnet produces the arc deflection force extending perpendicular to the longitudinal axis when the rotatable arm is moved from the closed position to the opened position.

7. The compact electrical switch device of claim 1, wherein the compact electrical switch device is configured as a contactor device or a fusible disconnect switch device.

8. An electrical switch device comprising:

a nonconductive switch housing;

a first terminal member connectable to a higher voltage DC power supply circuit having a voltage higher than 125 VDC;

a second terminal member connectable to a load-side circuit;

a current path defined internal to the nonconductive switch housing from the first terminal member to the second terminal member, the current path including a switch mechanism comprising:

a first switch contact provided on the first terminal member and mounted stationary in the nonconductive switch housing;

a rotatable arm provided with a second switch contact;

wherein the rotatable arm is selectively positionable between an opened position and a closed position to cause the second switch contact to travel along an arcuate path of motion toward and away from the first switch contact to connect or disconnect the first and second terminal members and accordingly complete or open the current path with a contact separation selected to disconnect the higher voltage DC power supply circuit in the current path;

a first plurality of stacked arc plates extending substantially parallel to one another, each of the first plurality of stacked arc plates including a leading edge defining a channel through which the arcuate path of motion of the second switch contact passes, each of the first plurality of stacked arc plates further including a second edge opposite from the leading edge and generally parallel to the leading edge, each of the first plurality of stacked arc plates further including longitudinal edges generally perpendicular to the leading edge and the second edge; and a first magnet establishing a magnetic field across the first plurality of stacked arc plates, wherein the first magnet is arranged on the second edge of the first plurality of stacked arc plates, and an arc deflection force generated by the first magnet is directed towards a longitudinal side edge of the channel that is generally perpendicular to the leading edge;

wherein when the rotatable arm is in the closed position under a direct current voltage electrical load, the magnetic field produces the arc deflecting force as the second switch contact is being separated from the first switch contact along the arcuate path of motion, the electrical switch device does not include a circuit breaker, and the electrical switch device does not include a magnet positioned generally parallel to the longitudinal edges of the first plurality of stacked arc plates.

9. The switch device of claim 8, wherein the switch mechanism further comprises:

a third switch contact mounted stationary in the nonconductive switch housing;

a fourth switch contact provided on the rotatable arm and movable along an arcuate path of motion toward and away from the third switch contact;

a second plurality of stacked arc plates extending substantially parallel to one another, each of the second plurality of stacked arc plates including a leading edge defining a channel through which the arcuate path of motion of the fourth switch contact passes; and at least a second magnet establishing a magnetic field across the second plurality of stacked arc plates.

10. The switch device of claim 8, wherein the current path further comprises a first fuse contact member and a second fuse contact member configured to receive respective terminal elements of an overcurrent protection fuse.

11. A compact fusible disconnect switch comprising:

a nonconductive housing defining a fuse receptacle;

a line-side terminal coupled to the nonconductive housing and including a first stationary contact in the nonconductive housing;

a line-side fuse terminal including a second stationary contact;

a rotatable arm carrying a first movable switch contact and a second movable switch contact spaced apart from one another, the first and second movable switch contacts completing an electrical path from the line-side terminal to the line-side fuse terminal when in a closed position and disconnecting the line-side terminal from the line-side fuse terminal when in an opened position at a contact separation selected to disconnect a higher voltage DC circuit connected to the line-side terminal, wherein the higher voltage DC circuit has a voltage higher than 125 VDC;

a first plurality of stacked arc plates extending substantially parallel to one another at a first location proximate the first movable switch contact and a second plurality of stacked arc plates extending substantially parallel to one another at a second location proximate the second movable switch contact, wherein the first and second plurality of stacked arc plates respectively includes a leading edge defining a channel through which a respective arcuate path of motion of the first movable switch contact and the second movable switch contact passes, the first and second plurality of stacked arc plates respectively further including a second edge opposite the leading edge and generally parallel to the leading edge, the first and second plurality of stacked arc plates respectively further including longitudinal edges generally perpendicular to the leading edge and the second edge;

a first magnet establishing a first magnetic field across the first plurality of stacked arc plates, wherein the first magnet is arranged on the second edge of the first plurality of stacked arc plates, and an arc deflection force generated by the first magnet is directed towards a longitudinal side edge of the channel that is generally perpendicular to the leading edge; and a second magnet establishing a second magnetic field across the second plurality of stacked arc plates, wherein the compact fusible disconnect switch does not include a circuit breaker, and the compact fusible disconnect switch does not include a magnet positioned generally parallel to the longitudinal edges of the first plurality of stacked arc plates.

12. The compact fusible disconnect switch of claim 11, wherein the first and second magnetic fields are sufficient in strength to produce respective arc deflecting forces in the respective direction of the first and second plurality of stacked arc plates to dissipate electrical arcing under a direct current voltage load exceeding 125 VDC.

* * * * *